US010407874B2

(12) United States Patent
Kajita et al.

(10) Patent No.: US 10,407,874 B2
(45) Date of Patent: Sep. 10, 2019

(54) CONTROL DEVICE AND WORKING MACHINE

(71) Applicant: Caterpillar SARL, Geneva (CH)

(72) Inventors: Shigeo Kajita, Tokyo (JP); Kouji Kishida, Tokyo (JP); Yoshihiko Hata, Tokyo (JP); Nobuaki Matoba, Kobe (JP)

(73) Assignee: Caterpillar SARL, Geneva (CH)

( * ) Notice: Subject to any disclaimer, the term of this patent is extended or adjusted under 35 U.S.C. 154(b) by 277 days.

(21) Appl. No.: 15/301,824

(22) PCT Filed: Apr. 17, 2015

(86) PCT No.: PCT/EP2015/058433
§ 371 (c)(1),
(2) Date: Oct. 4, 2016

(87) PCT Pub. No.: WO2015/158914
PCT Pub. Date: Oct. 22, 2015

(65) Prior Publication Data

US 2017/0121944 A1 May 4, 2017

(30) Foreign Application Priority Data

Apr. 18, 2014 (JP) ..... 2014-086638

(51) Int. Cl.
*E02F 9/20* (2006.01)
*F15B 1/027* (2006.01)
(Continued)

(52) U.S. Cl.
CPC ..... *E02F 9/2242* (2013.01); *E02F 3/96* (2013.01); *E02F 9/2066* (2013.01);
(Continued)

(58) Field of Classification Search
CPC ..... E02F 9/2242; E02F 9/2296; E02F 9/2292; E02F 9/2075; E02F 9/2217; F15B 1/027;
(Continued)

(56) References Cited

U.S. PATENT DOCUMENTS 7,234,298 B2 * 6/2007 Brinkman ..... E02F 9/2217 60/414
8,209,975 B2 * 7/2012 Persson ..... F15B 21/14 60/413
(Continued)

FOREIGN PATENT DOCUMENTS

JP 2008-185099 A 8/2008
JP 2008-196165 A 8/2008
(Continued)

OTHER PUBLICATIONS

European Patent Office, International Search Report in International Patent Application No. PCT/EP2015/058433, dated Jul. 17, 2015, 2 pp.

*Primary Examiner* — Nathaniel E Wiehe
*Assistant Examiner* — Dustin T Nguyen

(57) ABSTRACT

A control device for suppressing engine load fluctuation according to main pump circuit conditions, wherein an assist torque calculation task includes a target engine torque calculation task separating smooth torque components from main pump load torque and setting a minimum value of either smooth torque component or engine setting torque as target engine torque, and a subtractor calculating target assist torque based on a difference between the main pump load torque and the target engine torque, the assist torque calculation task controlling a capacity of an assist pump based on the target assist torque and controlling switching between an assist mode and a charge mode.

6 Claims, 11 Drawing Sheets

(51) Int. Cl.

| | |
|---|---|
| ***E02F 9/22*** | (2006.01) |
| ***E02F 3/96*** | (2006.01) |
| ***F15B 11/10*** | (2006.01) |
| ***F15B 13/04*** | (2006.01) |

(52) U.S. Cl.
CPC ..... *E02F 9/2075* (2013.01); *E02F 9/2217* (2013.01); *E02F 9/2292* (2013.01); *E02F 9/2296* (2013.01); *F15B 1/027* (2013.01); *F15B 11/10* (2013.01); *F15B 13/0416* (2013.01); *E02F 9/2285* (2013.01); *F15B 2201/51* (2013.01); *F15B 2211/605* (2013.01); *F15B 2211/633* (2013.01); *F15B 2211/6306* (2013.01); *F15B 2211/6333* (2013.01); *F15B 2211/6346* (2013.01); *F15B 2211/6651* (2013.01); *F15B 2211/6656* (2013.01); *F15B 2211/6658* (2013.01); *F15B 2211/7058* (2013.01); *F15B 2211/763* (2013.01); *F15B 2211/765* (2013.01)

(58) Field of Classification Search
CPC ..... F15B 13/0416; F15B 2211/763; F15B 2211/633; F15B 2211/6346; F15B 2211/6333; F15B 2211/6656; F15B 2211/6658; F15B 2211/6651
USPC ..... 60/428, 429, 430, 445
See application file for complete search history.

(56) References Cited

U.S. PATENT DOCUMENTS

| | | | | |
|---|---|---|---|---|
| 8,874,327 | B2 * | 10/2014 | Ishihara | E02F 9/2246 701/50 |
| 9,126,587 | B2 * | 9/2015 | Yamazaki | B60W 20/19 |
| 9,279,236 | B2 * | 3/2016 | Zhang | E02F 9/2217 |
| 9,399,856 | B2 * | 7/2016 | Fujishima | B60W 20/00 |
| 9,593,467 | B2 * | 3/2017 | Kajita | F15B 21/14 |
| 2010/0218493 | A1 * | 9/2010 | Nakamura | E02F 9/2235 60/426 |
| 2013/0006457 | A1 | 1/2013 | Anders et al. | |
| 2015/0192149 | A1 * | 7/2015 | Ma | F15B 1/0275 60/327 |

FOREIGN PATENT DOCUMENTS

| | | | |
|---|---|---|---|
| JP | 2009-275773 | A | 11/2009 |
| JP | 2010-084888 | A | 4/2010 |
| JP | 2006-322578 | A | 11/2016 |
| WO | WO 2014/115645 | A1 | 7/2014 |

* cited by examiner 7,8 main pump
10 assist pump
10 φ swash plate angle adjusting unit
32 accelerator means
33,34 pump pressure sensor
41 engine actual torque acquiring means

CONTROL DEVICE AND WORKING MACHINE

CROSS-REFERENCE TO RELATED APPLICATIONS

This application is a national phase application of International Patent Application No. PCT/EP2015/058433, filed Apr. 17, 2015, which claims priority to Japanese Patent Application No. JP 2014-086638, filed Apr. 18, 2014, both of which are incorporated by reference herein in their entireties for all purposes.

TECHNICAL FIELD

The present invention relates to a control device including an assist pump and an accumulator and a working machine mounted with the control device.

BACKGROUND ART

As an example of an energy regeneration system in a working machine hydraulically driven such as a hydraulic shovel, there is a system in which a fluid pressure motor such as a variable capacity hydraulic motor is set in-line in a return fluid passage provided between a control valve and a tank, an input shaft of a fluid pressure pump such as a variable capacity hydraulic pump is connected to an output shaft of the fluid pressure motor via reduction gears, a supply port of a direction control valve is communicated with a discharge port of the fluid pressure port via a check valve, and one output port of the direction control valve is connected to an accumulator for pressure accumulation and the other output port is connected to a main pump circuit that supplies working fluid from a main pump to a fluid pressure actuator (see, for example, Patent Document 1).

This system supplies return fluid to the variable capacity hydraulic motor, drives the variable capacity hydraulic pump to accumulate pressure in the accumulator, supplies pressure oil of the accumulator to the main pump during actuator actuation, and regenerates energy.

There is a power regenerating mechanism that increases pressure of the pressurized oil discharged from a head end of a boom cylinder with a pump motor and accumulates the pressurized oil in an accumulator during boom lowering of a hydraulic shovel, accumulates the pressurized oil released from a swing motor driving circuit in the accumulator during acceleration and deceleration of swing, and, when the accumulator is in a saturated state, guides the pressurized oil to the pump motor and causes the pump motor to perform motor operation, to assist engine power (see, for example, Patent Document 2).

Besides, in recent years, in a working machine such as a hydraulic shovel, a hybrid system obtained by combining a hydraulic system and an electric system has been attempted. For example, a generator motor is provided in an engine driving unit, the generator motor is adopted for swing driving, an upper swing body is driven by the generator motor and brake energy is converted into electricity to charge a capacitor and/or a battery during swing braking, and accumulated electric power is used for the swing driving. The capacitor or battery is charged by the generator motor directly connected to the engine during light engine load and power assist is performed by the generator motor using the charged electric power during heavy load.

Patent Document 1: Japanese Patent Application Laid-open No. 2006-322578

Patent Document 2: Japanese Patent Application Laid-open No. 2010-084888

DISCLOSURE OF THE INVENTION

Problems of the conventional techniques are summarized below.

In the energy regenerating system including the accumulator described in Patent Document 1 and Patent Document 2, when the pressurized oil which is accumulated in the accumulator is supplied to the hydraulic actuator, amount of the pressurized oil supplied from the accumulator may fluctuate as hydraulic status of the main pump circuit or the other reason. Therefore, stable energy regeneration cannot be performed.

On the other hand, in the hybrid system obtained by combining the hydraulic system and the electric system, large-capacity generator motor, capacitor and battery, and electric control devices that perform electric control of those generator motor, capacitor, and battery are necessary so that cost of the machine is higher. Further, there is a problem in that the hybrid system cannot be mounted on a conventional machine through simple rework.

The present invention has been devised in view of such points and it is an object of the present invention to provide a small and inexpensive control device that can effectively suppress load fluctuation of an engine according to a state of a main pump circuit, for example, and a working machine mounted with the control device.

An invention described in claim 1 is a control device including: a main pump driven by an engine and supplying hydraulic oil to a hydraulic circuit; a variable capacity assist pump coupled to an engine or a main pump and having both functions of a pump and a motor; an accumulator provided to be able to communicate with the assist pump and accumulate hydraulic energy; accelerator means for inputting engine setting torque; engine actual torque acquiring means for detecting or calculating engine actual torque; engine control means for controlling the engine actual torque; and assist pump control means for controlling the capacity of the assist pump and switching between an assist mode for assisting the engine with the motor function of the assist pump and a charge mode for accumulating pressure in the accumulator with the pump function of the assist pump, wherein the assist pump control means includes: main pump load torque calculating means for calculating main pump load torque applied to the main pump; engine target torque calculating means for separating a smooth torque component from the main pump load torque and setting a minimum of the smooth torque component and the engine setting torque, as engine target torque; assist target torque calculating means for calculating assist target torque from a difference between the main pump load torque and the engine target torque; and a function for controlling the capacity of the assist pump and controlling the switching of the assist mode and the charge mode on the basis of the assist target torque.

An invention described in claim 2 is the control device according to claim 1, wherein the assist pump includes: a swash plate for variably adjusting a pump capacity; and a swash plate angle adjusting unit that adjusts an angle of the assist pump swash plate, the assist pump control means includes: accumulator pressure detecting means for detecting accumulator pressure of the accumulator; assist pump differential pressure acquiring means for detecting inlet pressure and outlet pressure of the assist pump and thereby calculating assist pump differential pressure; assist torque calculating means for multiplying the assist target torque with an engine load ratio, which is calculated by dividing the engine target torque by the engine setting torque, to obtain assist torque as feed-forward torque; engine torque feedback control means for calculating assist correction torque on the basis of a deviation signal obtained by feeding back the engine actual torque to the engine target torque; an adder that adds up the assist torque calculated by the assist torque calculating means and the assist correction torque calculated by the engine torque feedback control means thereby obtaining assist request torque; and assist pump swash plate control means for receiving inputs of the assist request torque, the accumulator pressure, and the assist pump differential pressure to calculate an assist pump swash plate angle, thereby outputting an assist pump swash plate command and controlling the assist pump swash plate angle to smooth the engine actual torque.

An invention described in claim 3 is the control device according to claim 2, wherein the assist torque calculating means includes: a divider that divides the engine target torque by the engine setting torque to calculate the engine load ratio; a correction coefficient setter that adjusts the assist torque to increase when the engine load ratio is high and adjusts the charge torque to increase when the engine load ratio is low; and a multiplier that multiplies the assist target torque with an output of the correction coefficient setter to correct the assist target torque.

An invention described in claim 4 is a control device including: a main pump driven by an engine and supplying hydraulic oil to a hydraulic circuit; a variable capacity assist pump coupled to an engine or a main pump and having both functions of a pump and a motor; an accumulator provided be capable of connecting with the assist pump to accumulate hydraulic energy; accelerator means for inputting engine setting torque; engine actual torque acquiring means for detecting or calculating engine actual torque; engine control means for controlling the engine actual torque; and assist pump control means for controlling the capacity of the assist pump and switching between an assist mode for assisting the engine with the motor function of the assist pump and a charge mode for accumulating pressure in the accumulator with the pump function of the assist pump, wherein the assist pump control means includes: main pump load torque calculating means for calculating main pump load torque applied to the main pump; engine target torque calculating means for separating a smooth torque component from the main pump load torque and setting a minimum of the smooth torque component and the engine setting torque as engine target torque; a subtracter that calculates a deviation between the engine target torque and the engine actual torque; a control, operation unit that subjects an output of the subtracter to PID operation processing to obtain a torque command value of the assist pump; a pump pressure sensor that detects main pump pressure; a switch that implements switching to set the torque command value of the assist pump to zero when the main pump pressure is higher than specified pressure, and select an output of the control operation unit and set the output as the torque command value of the assist pump when the main pump pressure is lower than the specified pressure; and a function for controlling the capacity of the assist pump on the basis of the torque command value and controlling the switching of the assist mode and the charge mode.

An invention described in claim 5 is a working machine including: a machine body hydraulically driven; a working device mounted on the machine body; and the control device described in any one of claims 1 to 4 provided for the machine body and the working device, wherein the accumulator of the control device includes a function of accumulating and discharging brake energy of the machine body and position energy of the working device.

According to the invention described in claim 1, the smooth torque component is separated from the main pump load torque and the minimum of the smooth torque component and the engine setting torque is set as the engine target torque by the engine target torque calculating means. The assist target torque is calculated from the difference between the main pump torque and the engine target torque by the assist target torque calculating means. The capacity of the assist pump and the switching of the assist mode of the engine and the charge mode of the accumulator are controlled by the assist pump control means on the basis of the assist target torque. It is possible to smooth the engine target torque by absorbing load fluctuation with the assist pump control means having high responsiveness to a torque request that frequently changes. It is possible to smoothly change the engine actual torque according to the engine target torque. Since a large-capacity generator motor, battery, or the like is unnecessary, it is possible to provide a small and inexpensive control device that can effectively suppress load fluctuation of the engine according to, for example, a state of the main pump circuit. In particular, the engine target torque calculating means sets the minimum of the smooth torque component, which is separated from the main pump load torque, and the engine setting torque as the engine target torque. Therefore, when the pressure of the accumulator decreases, control is performed to gradually increase the engine target torque to perform charging. Therefore, it is possible to more flatly change the engine target torque smoothed by the engine setting torque. It is possible to effectively suppress load fluctuation of the engine. It is also possible to attain suppression of exhaust gas and a reduction in the sizes of the engine and a post processing device.

According to the invention described in claim 2, the assist target torque is multiplies with the engine load ratio calculated by dividing the engine target torque by the engine setting torque to calculate the assist torque as the feed-forward torque. The assist correction torque is calculated on the basis of the deviation signal obtained by feeding back the engine actual torque to the engine target torque. The assist torque and the assist correction torque are added up to calculate the assist request torque. Therefore, according to the accurate assist request torque corrected by the engine load ratio and the engine actual torque, it is possible to output an accurate assist pump swash plate command to the assist pump that variably adjusts the pump capacity according to the assist pump swash plate angle.

According to the invention described in claim 3, the engine target torque is divided by the engine setting torque to calculate the engine load ratio. The assist target torque is corrected to increase the assist torque when the engine load ratio is high and increase the charge torque when the engine load ratio is low. Therefore, it is possible to appropriately adjust the assist target torque according to a load state of the engine.

According to the invention described in claim 4, the smooth torque component is separated from the main pump load torque and the minimum of the smooth torque component and the engine setting torque is set as the engine target torque by the engine target torque calculating means. The deviation between the engine target torque and the engine actual torque is subjected to the PID control to calculate the torque command value of the assist pump. The capacity of the assist pump and the switching of the assist mode of the engine and the charge mode of the accumulator are controlled on the basis of the torque command value. It is possible to smooth the engine target torque by absorbing load fluctuation with the assist pump control means having high responsiveness to a torque request that frequently changes. It is possible to smoothly change the engine actual torque according to the engine target torque. Moreover, since a large-capacity generator motor, battery, or the like is unnecessary, it is possible to provide a small and inexpensive control device that can effectively suppress load fluctuation of the engine according to, for example, a state of the main pump circuit. Further, the switching is performed by the switch to set the torque command value of the assist pump to zero when the main pump pressure is higher than the specified pressure, and set the output of the control operation unit as the torque command value of the assist pump when the main pump pressure is lower than the specified pressure. Therefore, in the case of a relief state in which the main pump pressure is higher than the specified pressure, the torque command value of the assist pump is set to zero to stop the assist of the engine and, when the main pump pressure is lower than the specified pressure, the assist of the engine is resumed. Therefore, it is possible to prevent useless consumption of energy accumulated by the accumulator.

According to the invention described in claim 5, when the machine body and the working device are actuated in the working machine hydraulically driven, the brake energy and the position energy of the working machine can be effectively used by the accumulator of the control device including the function of accumulating and discharging the brake energy of the machine body and the position energy of the working machine. It is possible to effectively suppress load fluctuation of the engine. It is possible to attain suppression of exhaust gas and a reduction in the sizes of the engine and a post processing device.

BEST MODE FOR CARRYING OUT THE INVENTION

The present invention is explained in detail below on the basis of an embodiment shown in FIG. 1 to FIG. 16 and another embodiment shown in FIG. 17.

(A System of an Engine Assist Device)

Figure 2:
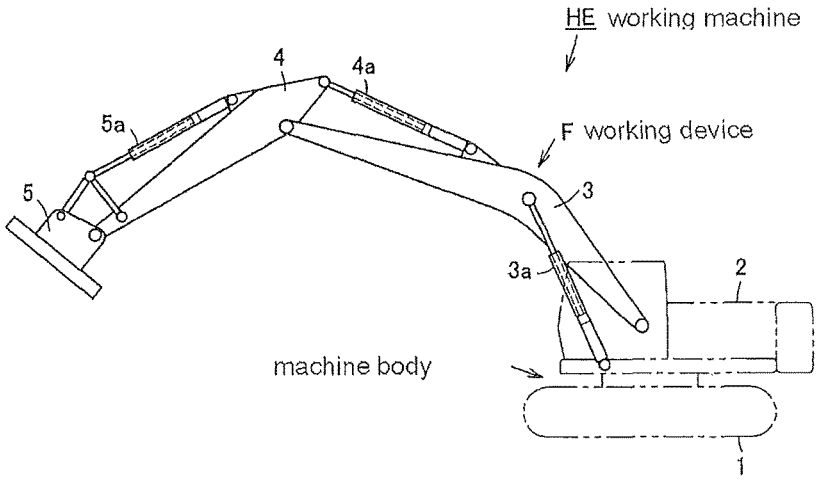
FIG. 2 is a side view of a working machine mounted with the control device.

FIG. 2 shows a working machine HE for magnet work in which a hydraulic shovel is a base machine. In the working machine HE, a machine body B is configured by a lower traveling body 1 and an upper swing body 2 turnably provided on the lower traveling body 1. A front working device F functioning as a working device is mounted on the upper swing body 2. In the front working device F, the base end of a boom 3 is pivotally supported by the upper swing body 2 to be rotatable in the up-down direction. An arm 4 is pivotally connected to the tip of the boom 3. An attachment (a lifting magnet) 5 is pivotally connected to the tip of the arm 4. The boom 3 of the front working device F is rotated by a boom cylinder 3*a*. The arm 4 is rotated by an arm cylinder 4*a*. The attachment 5 is rotated by a bucket cylinder 5*a*, which is originally used for bucket rotation.

Figure 1:
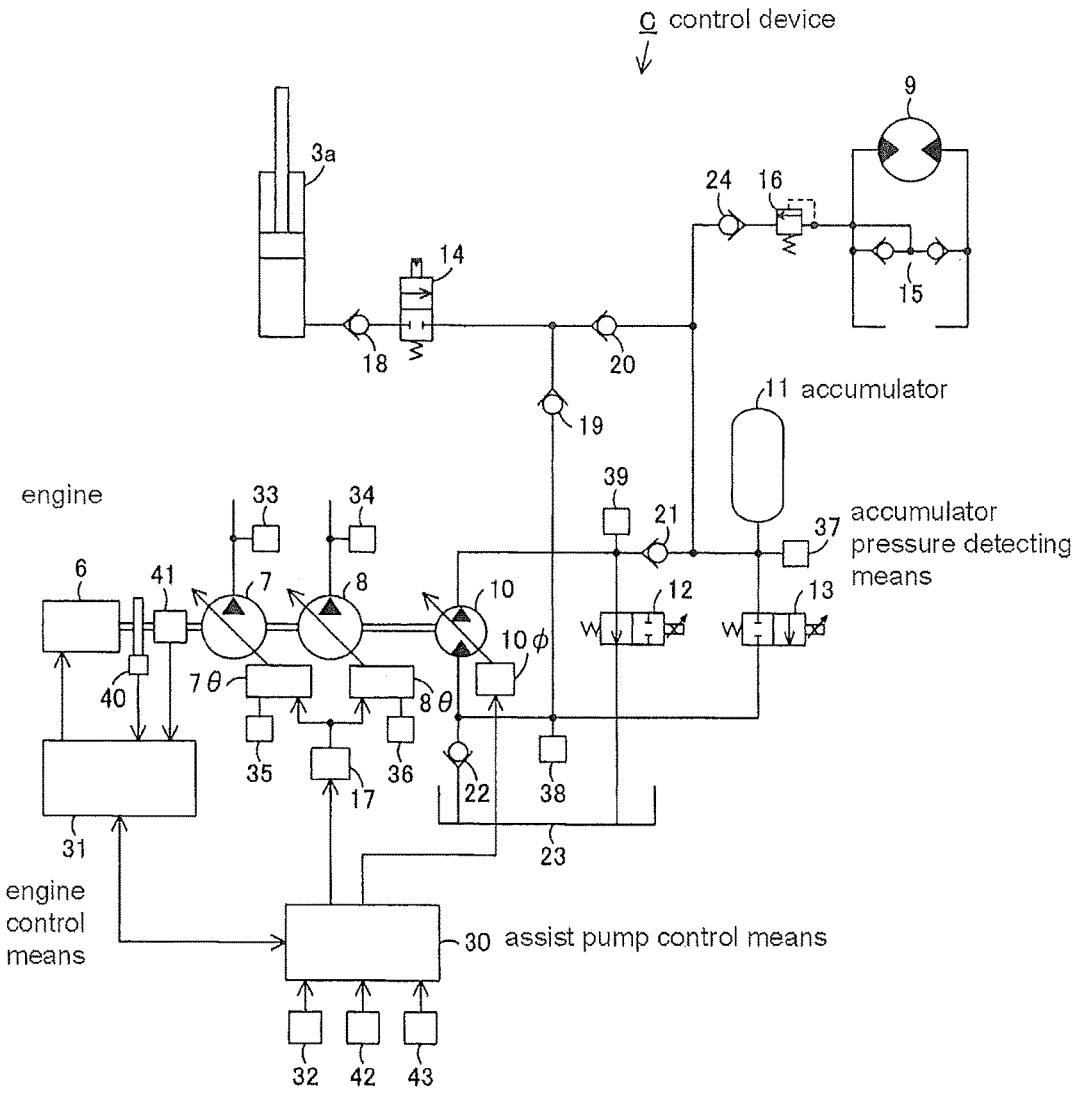
FIG. 1 is a circuit diagram showing an embodiment of a control device according to the present invention.

FIG. 1 shows the configuration of mainly a hydraulic system of a control device C provided for the machine body B and the front working device F. In FIG. 1, a front pump 7 and a rear pump 8 functioning as main pumps (these pumps are hereinafter referred to as main pumps 7 and 8) driven by an engine 6 mounted on the upper swing body 2 and a part (a boom cylinder 3*a* and a swing motor 9 that drives to turn the upper swing body 2) of a hydraulic actuator that receives supply of hydraulic oil from the main pumps 7 and 8 are shown.

A main pump circuit (not shown in the figure) that controls, with a control valve (not shown in the figure), the direction of the hydraulic oil discharged from the main pumps 7 and 8 and supplies the hydraulic oil to various hydraulic actuators such as the boom cylinder 3*a*, the arm cylinder 4*a*, the bucket cylinder 5*a*, the swing motor 9, and a traveling motor (not shown in the figure) is connected to discharge ports of the main pumps 7 and 8.

A variable capacity assist pump 10 having both functions of a pump and a motor is coupled to the engine 6 or the main pumps 7 and 8. In a passage where the pressure oil discharged from the assist pump 10 and the pressure oil discharged from the boom cylinder 3*a* and the swing motor 9 merge, an accumulator 11 that accumulates the pressure of the pressure oils to accumulate energy is provided.

A passage on an outlet side of the assist pump 10 is connected to an unload valve 12 capable of opening the passage on the outlet side to a tank 23. In a passage through which the accumulator 11 and an inlet side of the assist pump 10 can communicate with each other, an accumulator regeneration valve 13 for supplying the pressure oil accumulated (charged) in the accumulator 11 to the inlet side of the assist pump 10 is provided. The unload valve 12 and the accumulator regeneration valve 13 are electromagnetic valves opened and closed according to on/off electric signals.

In a passage between a head end of the boom cylinder 3*a* and the accumulator 11, a boom regeneration valve 14 that can supply the pressure oil in a head chamber of the boom cylinder 3*a* to the accumulator 11 by being switched by not-shown boom lowering pilot pressure is provided. The boom regeneration valve 14 is an on/off valve pilot-operated by pilot pressure from an electromagnetic valve (not shown in the figure).

A high-pressure selection valve 15 configured by a pair of check valves is provided between left and right ports of the swing motor 9. A sequence valve 16 and a check valve 24 for accumulating pressure in the accumulator 11 while keeping brake pressure are provided in a passage drawn out from between the check valves of the high-pressure selection valve 15.

The main pumps 7 and 8 include variable capacity swash plates and adjust swash plate angles with swash plate angle adjusting units 7θ and 8θ such as pump regulators to variably control pump capacities. An output circuit of an electromagnetic proportional valve for power shift 17 is connected to the swash plate angle adjusting units 7θ and 8θ. The electromagnetic proportional valve for power shift 17 outputs hydraulic pressure proportional to an input electric signal to the swash plate angle adjusting units 7θ and 8θ and variably controls the pump capacities to adjust the torque of the main pumps 7 and 8.

The assist pump 10 includes a variable capacity swash plate and adjusts a swash plate angle with a swash plate angle adjusting unit 10ϕ to thereby variably control a pump capacity or a motor capacity. The swash plate angle adjusting unit 10ϕ proportionally operates according to an electric signal.

A check valve 18 is provided in a passage between the head end of the boom cylinder 3*a* and the boom regeneration valve 14. A check valve 19 is provided in a passage between the boom regeneration valve 14 and the inlet side of the assist pump 10. A check valve 20 is provided in a passage between the boom regeneration valve 14 and the accumulator 11. A check valve 21 is provided in a passage between the outlet side of the assist pump 10 and the accumulator 11. A check valve 22 is provided in a passage for supplying oil from the tank 23 to the inlet side of the assist pump 10. A backflow is prevented by the check valves 18 to 22.

Reference numeral 30 denotes a machine controller functioning as assist pump control means for controlling an engine assist system. An engine controller 31 functioning as engine control means for controlling the engine 6 is connected to the machine controller 30 to enable bidirectional communication.

An accelerator dial 32 functioning as accelerator means for setting engine speed and engine setting torque, pump pressure sensors 33 and 34 that detect discharge pressures of the main pumps 7 and 8, pump swash plate angle sensors 35 and 36 that detect swash plate angles of the main pumps 7 and 8, an accumulator pressure sensor 37 functioning as accumulator pressure detecting means for detecting accumulator pressure Pac of the accumulator 11, and an assist pump inlet pressure sensor 38 and an assist pump outlet pressure sensor 39 that detect pressures of the inlet and the outlet of the assist pump 10 are connected to an input side of the machine controller 30.

An engine speed sensor 40 that detects engine actual speed Ne and an engine torque sensor 41 functioning as engine actual torque acquiring means for detecting engine actual torque Tea are connected to the input side of the engine controller 31. Note that the engine actual torque acquiring means is not limited to the torque sensor 41 and also includes calculating means for estimating, with the engine controller 31, the engine actual torque Tea from a fuel injection amount, intake pressure, and the like of the engine 6.

An output side of the engine controller 31 is connected to a fuel injection device of a fuel supply system and control units of an air intake and exhaust system, a start control system, and the like of the engine 6. The engine controller 31 electronically controls fuel injection timing, a fuel injection amount, and the like of the fuel injection device and controls the engine actual torque Tea according to engine target torque Tet explained below.

An operation pilot pressure sensor 42 that detects operation pilot pressure Ppi (excluding boom lowering pilot pressure) for pilot-operating spools of a control valve (not shown in the figure), which controls various hydraulic actuators of the working machine HE, to detect an operation state of the working machine HE and a boom lowering pilot pressure sensor 43 that detects boom lowering pilot pressure Pbd for pilot-operating the boom cylinder 3*a* in a contracting direction are connected to the input side of the machine controller 30.

The output side of the machine controller 30 is connected to the electromagnetic proportional valve for power shift 17 that controls the swash plate angle adjusting units 7θ and 8θ of the main pumps 7 and 8, the swash plate angle adjusting unit 10ϕ that controls an assist pump swash plate angle ϕ when the swash plate of the assist pump 10 is subjected to angle adjustment, solenoids of the unload valve 12 and the accumulator regeneration valve 13, and an electromagnetic valve for pilot operation (not shown in the figure) of the boom regeneration valve 14.

The machine controller 30 includes a function for controlling the assist pump swash plate angle ϕ to control a pump capacity of the assist pump 10 and controlling the unload valve 12 and the accumulator regeneration valve 13 to switch an assist mode for assigning the engine 6 with the motor function of the assist pump 10 and a charge mode for accumulating pressure in accumulator 11 with the pump function of the assist pump 10.

Figure 3:
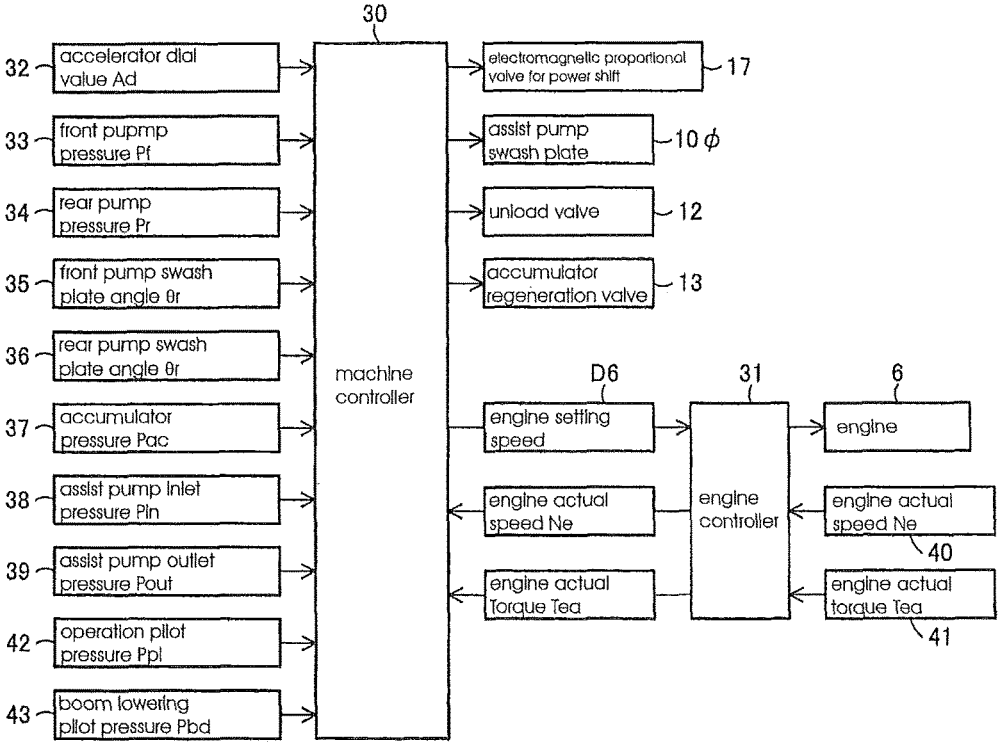
FIG. 3 is a block diagram showing an input/output relation of the control device.

FIG. 3 is a diagram summarizing input/output signals of the control device C.

In FIG. 3, to the machine controller 30, a set accelerator dial value Ad is input from the accelerator dial 32 for setting engine speed, front pump pressure Pf and rear pump pressure Pr serving as main pump pressures are input from the pump pressure sensors 33 and 34, a front pump swash plate angle θf and a rear pump swash plate angle θr are input from the pump swash plate angle sensors 35 and 36, accumulator pressure Pac is input from the accumulator pressure sensor 37, pump inlet pressure Pin is input from the assist pump inlet pressure sensor 38, assist pump outlet pressure Pout is input from the assist pump outlet pressure sensor 39, the operation pilot pressure Ppi is input from the operation pilot pressure sensor 42, and the boom lowering pilot pressure Pbd is input from the boom lowering pilot pressure sensor 43.

To the engine controller 31, the engine actual speed Ne is input from the engine speed sensor 40 and the engine actual torque Tea is input from the engine torque sensor 41. Further, data of the engine actual speed Ne and the engine actual torque Tea are sent from the engine controller 31 to the machine controller 30. Engine setting speed D6 corresponding to the accelerator dial value Ad is sent from the machine controller 30 to the engine controller 31.

On the other hand, from the machine controller 30, a control signal concerning the assist pump swash plate angle $\phi$ is output to the swash plate angle adjusting unit 10$\phi$ of the assist pump 10, switching signals for the unload valve 12 and the accumulator regeneration valve 13 are output to the unload valve 12 and the accumulator regeneration valve 13, and a control signal for power shift is output to the electromagnetic proportional valve for power shift 17.

Figure 4:
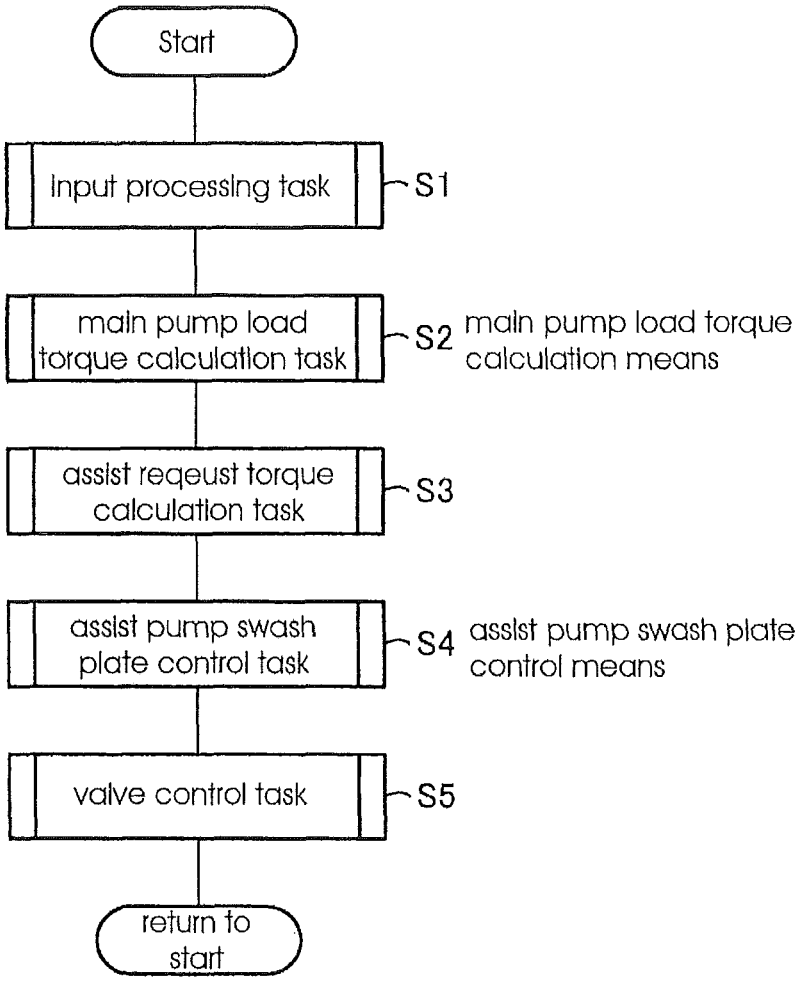
FIG. 4 is a flowchart for explaining a control flow of the control device.
Figure 5:
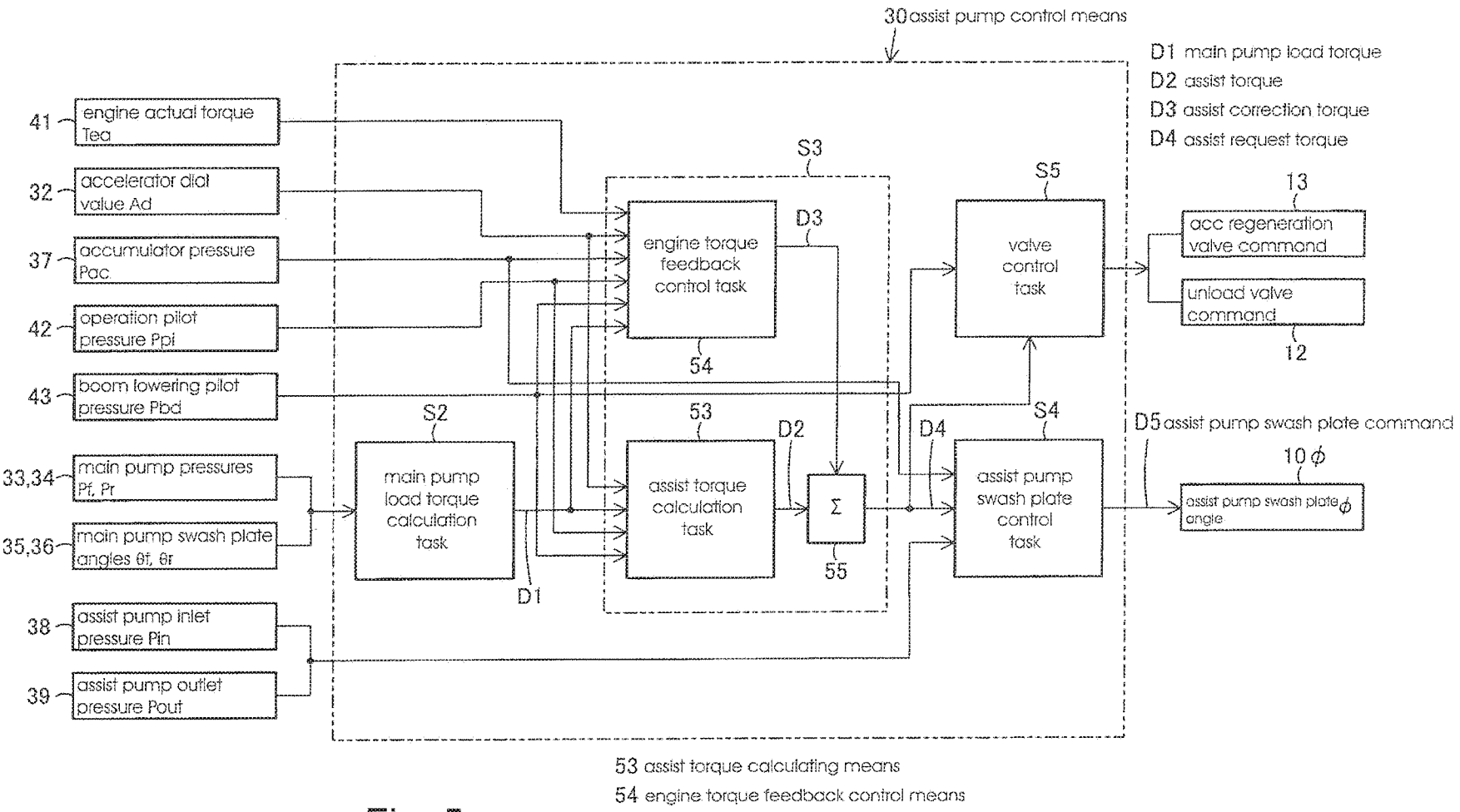
FIG. 5 is a control block diagram showing a relation among tasks of the control device.

FIG. 4 is a control flowchart, FIG. 5 is a control block diagram showing a relation among calculation tasks shown in FIG. 4, and FIG. 6 to FIG. 11 are calculation block diagrams of the control tasks. The configuration of a control system is explained on the basis of FIG. 4 to FIG. 11.

Note that the torque of the main pumps 7 and 8 is set on the basis of pump setting torque set by the accelerator dial 32 and the operation pilot pressure Ppi determined by an operation amount of operation levers or the like and is controlled via the electromagnetic proportional valve for power shift 17. However, the torque of the main pumps 7 and 8 is not explained because the torque is not directly related to engine assist control. Only components related to the engine assist control are explained.

(1) Explanation of an Entire Control Flowchart

FIG. 4 shows a control flowchart of entire engine assist control.

In an input processing task S1 of the control flowchart, the input signal shown in FIG. 3 is read.

A main pump load torque calculation task S2 functioning as main pump load torque calculation means calculates, as shown in FIG. 5, main pump load torque D1 according to the main pump pressures Pf and Pr detected by the pump pressure sensors 33 and 34 and the main pump swash plate angles $\theta$f and $\theta$r detected by the pump swash plate angle sensors 35 and 36. Note that the main pump load torque D1 may be predicted from the operation pilot pressure Ppi and the main pump pressures Pf and Pr.

An assist request torque calculation task S3 calculates, as shown in FIG. 5, assist request torque D4 on the basis of, for example, the main pump load torque D1 output from the main pump load torque calculation task S2.

An assist pump swash plate control task S4 functioning as assist pump swash plate control means calculates, as shown in FIG. 5, an assist pump swash plate command D5 according to the assist request torque D4 output from the assist request torque calculation task S3, the accumulator pressure Pac, and the like.

A valve control task S5 outputs, as shown in FIG. 5, switching signals for the unload valve 12 and the accumulator regeneration valve 13 according to the assist request torque D4 output from the assist request torque calculation task S3 and the boom lowering pilot pressure Pbd.

In short, the assist pump swash plate control task S4 and the valve control task S5 control the capacity (i.e., the assist pump swash plate angle $\phi$) of the assist pump 10 and the switching of the assist mode of the engine 6 and the charge mode of the accumulator 11 according to the assist request torque D4 or the like.

The control calculation tasks are explained below.

(2) Main Pump Load Torque Calculation Task S2

Figure 6:
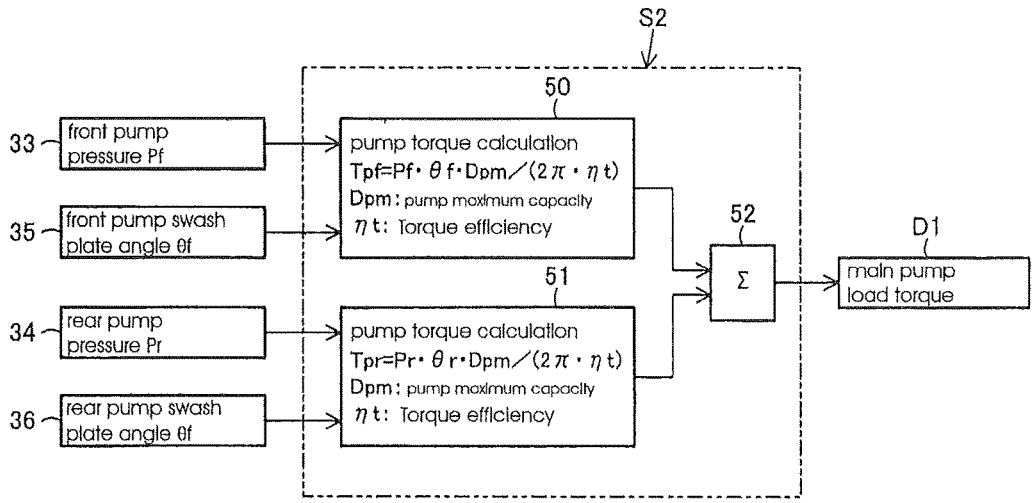
FIG. 6 is a calculation block diagram showing a main pump load torque calculation task of the control device.

FIG. 6 shows calculation blocks of the main pump load torque calculation task S2. The front pump pressure Pf and the rear pump pressure Pr detected by the pump pressure sensors 33 and 34 and the front pump swash plate angle $\theta$f and the rear pump swash plate angle $\theta$r detected by the pump swash plate angle sensors 35 and 36 are input to the main pump load torque calculation task S2.

Pump torque Tpf on a front side is calculated by a pump torque calculation block 50 on the basis of the front pump pressure Pf and the front pump swash plate angle $\theta$f. Pump torque Tpr on a rear side is calculated by a pump torque calculation block 51 on the basis of the rear pump pressure Pr and the rear pump swash plate angle $\theta$r. The pump torques Tpf and Tpr on the front side and the rear side are added up by an adder 52 and output as the main pump load torque D1.

The pump torque calculation block 50 on the front side calculates the pump torque Tpf according to the following expressions and outputs the pump torque Tpf.

$$Tpf=Pf\cdot\theta f\cdot Dpm/(2\pi\cdot\eta t)$$

Dpm: Front pump maximum capacity $\eta$t: Torque efficiency

The pump torque calculation block 51 on the rear side calculates the pump torque Tpr according to the following expression and outputs the pump torque Tpr.

$$Tpr=Pr\cdot\theta r\cdot Dpm/(2\pi\cdot\eta t)$$

Dpm: Rear pump maximum capacity $\eta$t: Torque efficiency (3) Assist Request Torque Calculation Task S3

Figure 7:
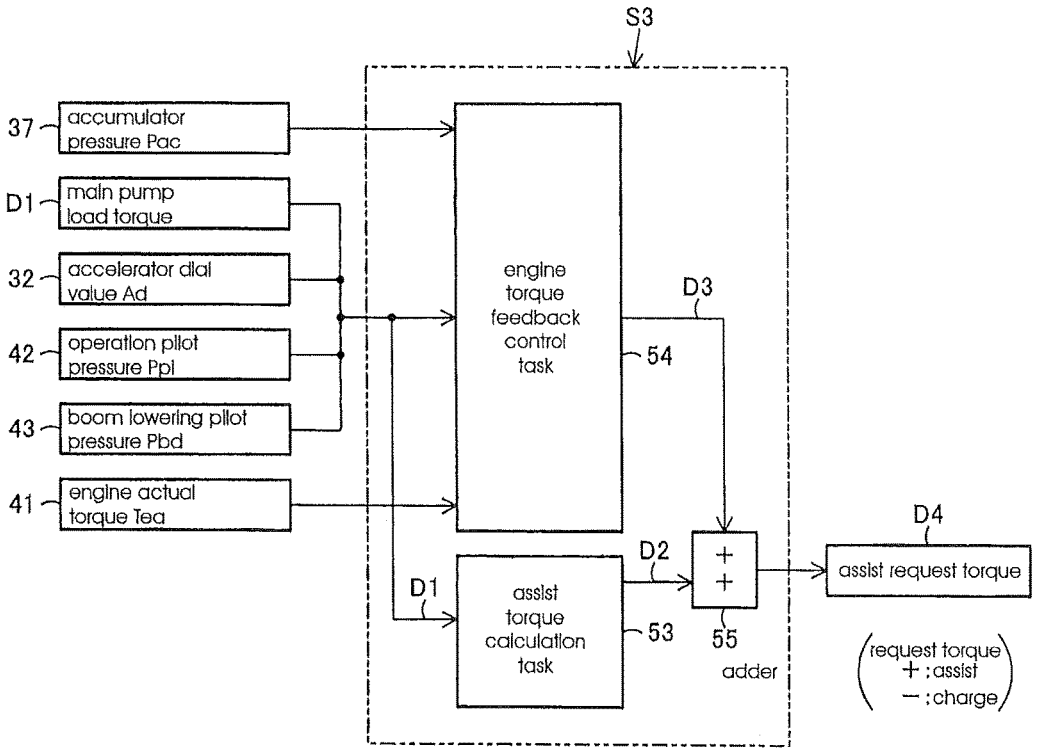
FIG. 7 is a calculation block diagram showing an assist request torque calculation task of the control device.

FIG. 7 shows calculation blocks of the assist request torque calculation task S3. In FIG. 7, the accumulator pressure Pac, the accelerator dial 32, the operation pilot pressure Ppi, the boom lowering pilot pressure Pbd, the engine actual torque Tea, and the main pump load torque D1 calculated by the main pump load torque calculation task S2 are input to the assist request torque calculation task S3.

The assist request torque calculation task S3 is configured from an assist torque calculation task 53 functioning as assist torque calculating means and an engine torque feedback control task 54 functioning as engine torque feedback control means. Outputs of both the tasks 53 and 54 are added up by an adder 55 and output as assist request torque D4.

Figure 8:
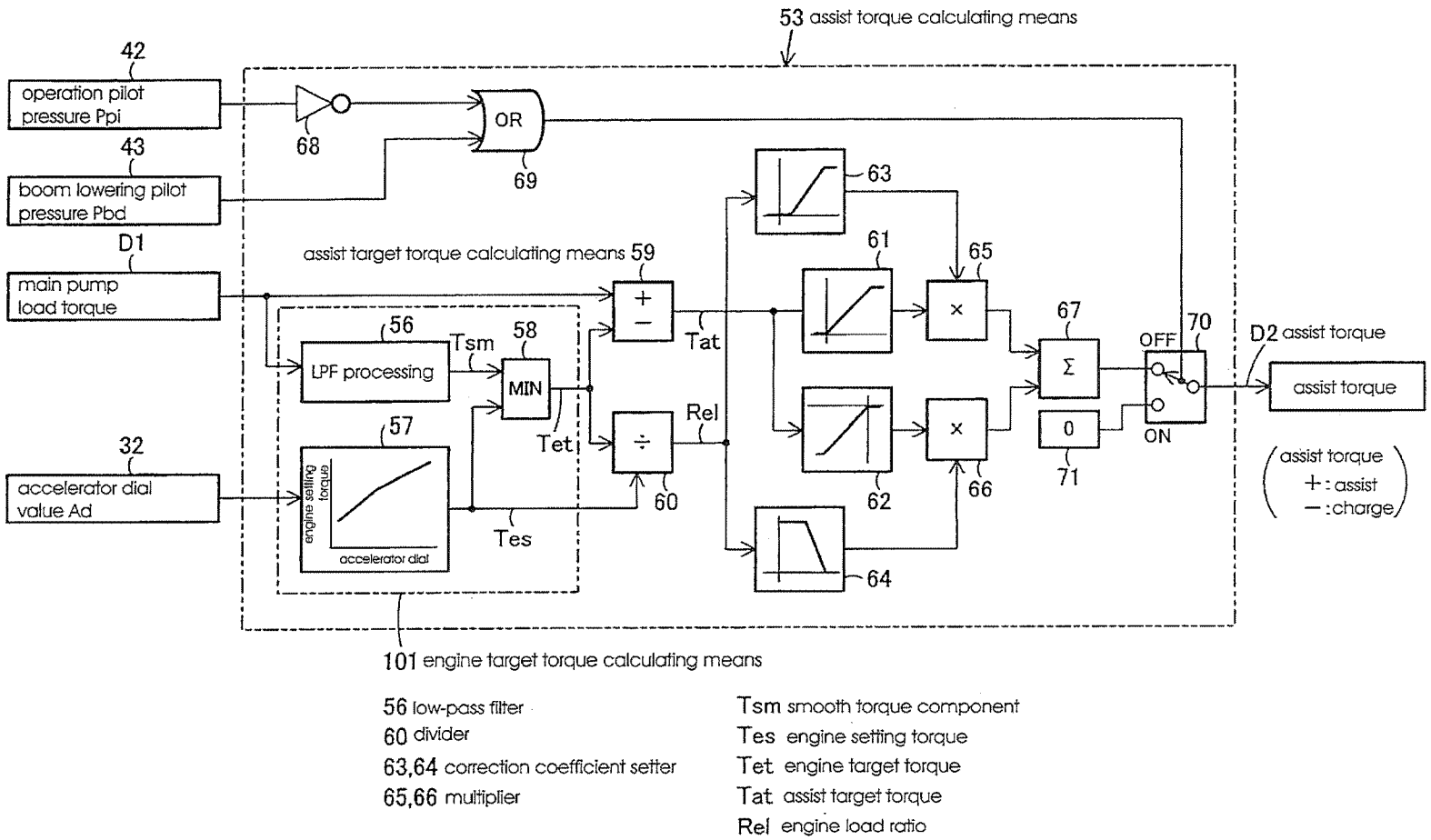
FIG. 8 is a calculation block diagram showing an assist torque calculation task of the control device.

FIG. 8 shows calculation blocks of the assist torque calculation task 53. The assist torque calculation task 53 includes an engine target torque calculation task 101 functioning as engine target torque calculating means including a low-pass filter 56 that applies filter processing to the main pump load torque D1, an engine setting torque table 57 that outputs engine setting torque on the basis of a signal of the accelerator dial 32, and a minimum selection calculator 58 (hereinafter referred to as Min calculator) that compares an output of the low-pass filter 56 and an output of the engine setting torque table 57 and selects a smaller value.

The assist torque calculation task 53 includes a subtracter 59 functioning as assist target torque calculating means for subtracting the engine target torque Tet output from the engine target torque calculation task 101 from the main pump load torque D1 to calculate assist target torque Tat.

The assist torque calculation task 53 separates, with the low-pass filter 56, a smooth torque component Tsm from the main pump load torque D1, calculates, with the Min calculator 58, a minimum of the smooth torque component Tsm and the engine setting torque Tes and sets the minimum as the engine target torque Tet, and subtracts, with the subtracter 59, the engine target torque Tet from the main pump load torque D1 to calculate the assist target torque Tat.

Further, the assist torque calculation task 53 includes a divider 60 that divides an output of the Min calculator 58 by the output of the engine setting torque table 57 and calculates an engine load ratio Rel, a lower limit limiter 61 that extracts a plus component of the assist target torque Tat output from the subtracter 59, an upper limit limiter 62 that extracts a minus component, an assist correction coefficient setter 63 functioning as a correction coefficient setter that outputs an assist correction coefficient according to the engine load ratio Rel calculated by the divider 60, a charge correction coefficient setter 64 functioning as a correction coefficient setter that outputs a charge correction coefficient, a multiplier 65 that multiplies the plus component of the assist target torque Tat output from the lower limit limiter 61 with an output of the assist correction coefficient setter 63, a multiplier 66 that multiplies the minus component of the assist target torque Tat output from the upper limit limiter 62 with an output of the charge correction coefficient setter 64, and an adder 67 that adds up outputs of the multiplier 65 and the multiplier 66.

The assist torque calculation task 53 includes a NOT operation unit 68 that reverses a signal of the operation pilot pressure Ppi and outputs a signal of OFF in machine operation and outputs a signal of ON in non-operation and an OR operation unit 69 that calculates an OR of an output of the NOT operation unit 68 and the boom lowering pilot pressure Pbd. An OR operation by the OR operation unit 69 is summarized in Tabled 1 below.

TABLE 1

| | | | | |
|---|---|---|---|---|
| Output of NOT operation unit 68 or 79 | Machine operation state OFF | Machine operation state OFF | Machine non-operation state ON | Machine non-operation state ON |
| Output of boom lowering pilot pressure Pbd | Boom lowering operation ON | Boom lowering non-operation OFF | Boom lowering operation ON | Boom lowering non-operation OFF |
| Output of OR operation unit 69 or 80 | ON | OFF | ON | ON |

Further, the assist torque calculation task 53 includes a switch 70 that switches according to an output of the OR operation unit 69. The switch 70 selects an output of the adder 67 when the output of the OR operation unit 69 is OFF and selects an output "0" of a zero setter 71 when the output of the OR operation unit 69 is ON.

Figure 9:
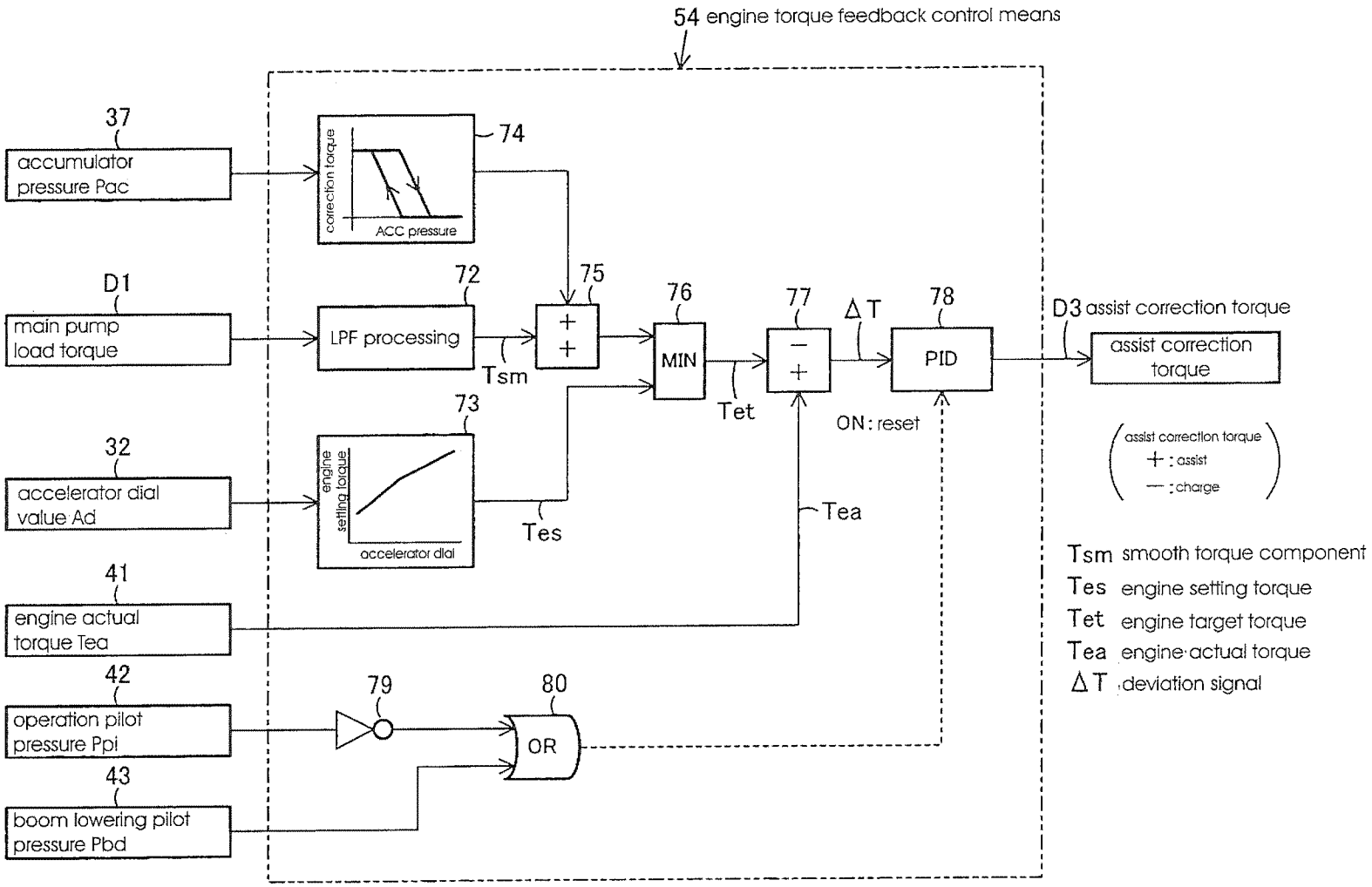
FIG. 9 is a calculation block diagram showing an engine torque feedback control task of the control device.

FIG. 9 shows calculation blocks of the engine torque feedback control task 54. The accumulator pressure Pac, the main pump load torque D1, the accelerator dial 32, the operation pilot pressure Ppi, the boom lowering pilot pressure Pbd, and the engine actual torque Tea are input to the engine torque feedback control task 54. Assist correction torque D3 is output as an output of a control operation.

The engine torque feedback control task 54 includes a low-pass filter 72 same as the low-pass filter 56 that separates and extracts the smooth torque component Tsm from the main pump load torque D1, an engine setting torque table 73 same as the engine setting torque table 57, a correction torque table 74 that outputs correction torque on the basis of the accumulator pressure Pac, an adder 75 that adds up the smooth torque component Tsm treated by the low-pass filter 72 and an output of the correction torque table 74, a Min calculator 76 that compares an output (the engine setting torque Tes) of the engine setting torque table 73 and an output of the adder 75 and selects a smaller value, a subtracter 77 that calculates a deviation signal ΔT obtained by feeding back the engine actual torque Tea to the engine target torque Tet output from the Min calculator 76, and a control operation unit 78 that subjects the deviation signal ΔT output from the subtracter 77 to PID operation processing.

Further, the engine torque feedback control task 54 includes a NOT operation unit 79 and an OR operation unit 80 that reverse a signal of the operation pilot pressure Ppi. The NOT operation unit 79 outputs a signal of OFF in machine operation and outputs a signal of ON in non-operation. The OR operation unit 80 calculates an OR of an output of the NOT operation unit 79 and the boom lowering pilot pressure Pbd. An output of the OR operation unit 80 is the same as the above Table 1. The control operation unit 78 is reset when the output of the OR operation unit 80 is ON. An output of the control operation unit 78 is output as the assist correction torque D3.

(4) Assist Pump Swash Plate Control Task S4

Figure 10:
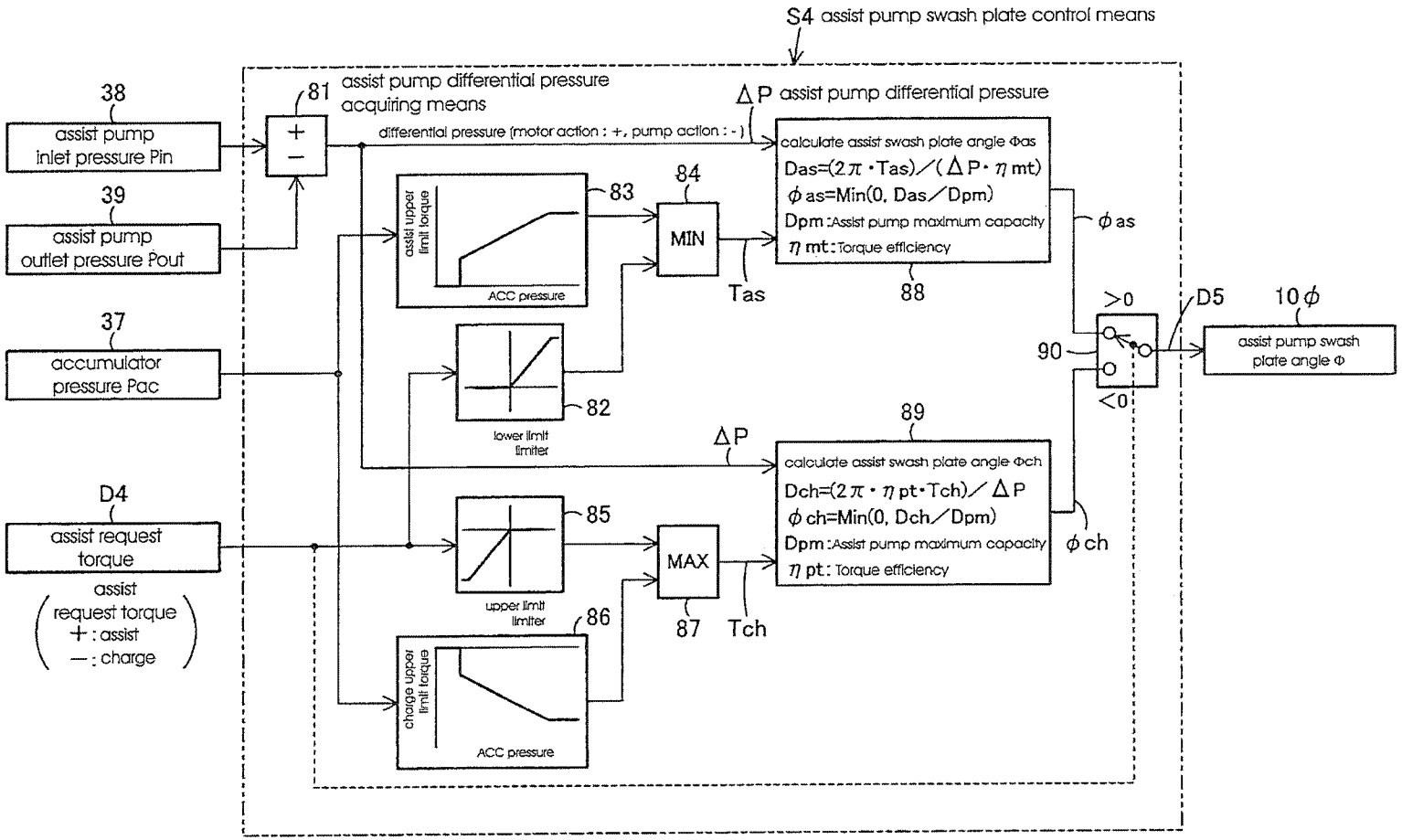
FIG. 10 is a calculation block diagram showing an assist pump swash plate control task of the control device.

FIG. 10 shows calculation blocks of the assist pump swash plate control task S4. The assist pump inlet pressure Pin, the assist pump outlet pressure Pout, the accumulator pressure Pac, and the assist request torque D4 are input to the assist pump swash plate control task S4. The assist pump swash plate command D5 is output from the assist pump swash plate control task S4.

The assist pump swash plate control task S4 includes a subtracter 81 functioning as assist pump differential pressure acquiring means for calculating an assist pump differential pressure ΔP between the assist pump inlet pressure Pin and the assist pump outlet pressure Pout, a lower limit limiter 82 that extracts a plus component of the assist request torque D4, an assist upper limit torque setter 83 that sets assist upper limit torque on the basis of the accumulator pressure Pac, a Min calculator 84 that compares an output of the lower limit limiter 82 and an output of the assist upper limit torque setter 83 and selects a smaller value, an upper limit limiter 85 that extracts a minus component of the assist request torque D4, a charge upper limit torque setter 86 that sets charge upper limit torque on the basis of the accumulator pressure Pac, and a maximum selection calculator (hereinafter referred to as Max calculator) 87 that compares an output of the upper limit limiter 85 and an output of the charge upper limit torque setter 86 and selects a larger value.

Further, the assist pump swash plate control task S4 includes an assist swash plate angle calculator 88 that calculates an assist swash plate angle ϕas in an engine assist mode of the assist pump 10 on the basis of an output T of the Min calculator 84 and the assist pump differential pressure ΔP output from the subtracter 81 and a charge swash plate angle calculator 89 that calculates a charge swash plate angle ϕas in an accumulator charge mode of the assist pump 10 on the basis of an output T of the Max calculator 87 and the assist pump differential pressure ΔP output from the subtracter 81.

The assist swash plate angle calculator 88 calculates the assist pump swash plate angle ϕ (the assist swash plate angle ϕas) according to the following expression and outputs the assist pump swash plate angle ϕ.

$$Das=(2\pi\cdot Tas)/(\Delta P\cdot\eta mt)$$

$$\phi as=\mathrm{Min}(0,Das/Dpm)$$

Dpm: Assist pump maximum capacity

ηmt: Torque efficiency

The charge swash plate angle calculator 89 calculates the assist pump swash plate angle ϕ (the charge swash plate angle ϕch) according to the following expression and outputs the assist pump swash plate angle ϕ.

$$Dch=(2\pi\cdot\eta pt\cdot Tch)/\Delta P$$

$$\phi ch=\mathrm{Min}(0,Dch/Dpm)$$

Dpm: Assist pump maximum capacity

ηpt: Torque efficiency

The assist pump swash plate control task S4 includes a switch 90 that switches an output (the assist swash plate angle ϕas) of the assist swash plate angle calculator 88 and an output (the charge swash plate angle ϕch) of the charge swash plate angle calculator 89 according to plus/minus of the assist request torque D4. The assist pump swash plate angle ϕ (the assist swash plate angle ϕas or the charge swash plate angle ϕch) serving as the assist pump swash plate command D5 is output from the switch 90 to the swash plate angle adjusting unit 10ϕ of the assist pump 10.

(5) Valve Control Task S5

Figure 11:
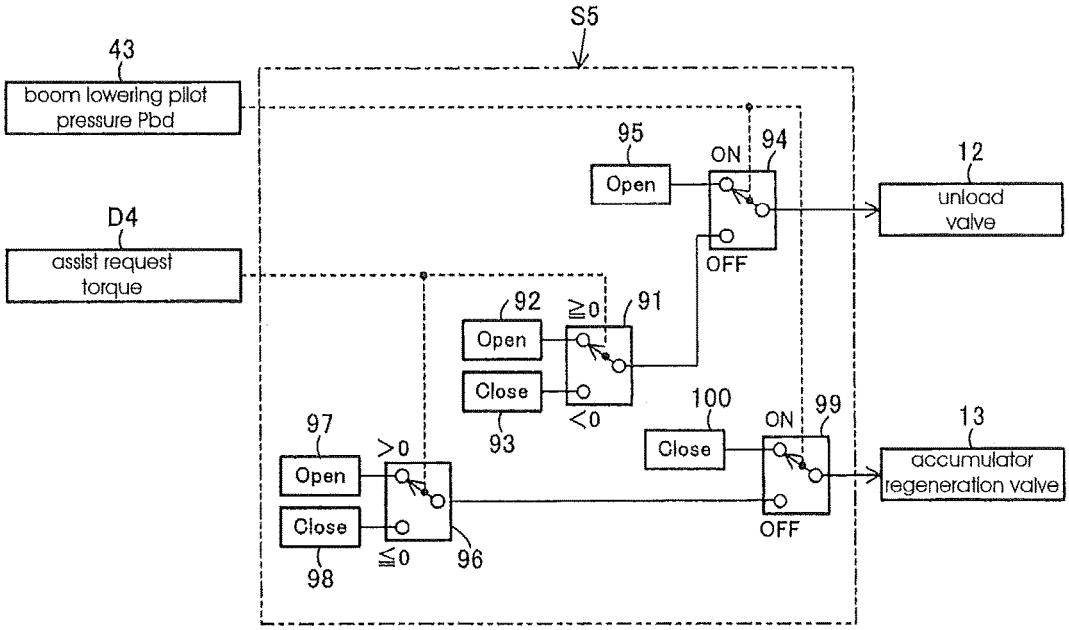
FIG. 11 is a calculation block diagram showing a valve control task of the control device.

FIG. 11 shows calculation blocks of the valve control task S5. The assist request torque D4 output from the assist pump swash plate control task S4 and the boom lowering pilot pressure Pbd are input to the valve control task S5. Switching signals for the unload valve 12 and the accumulator regeneration valve 13 are output on the basis of a control operation result.

The valve control task S5 includes a switch 91 that switches according to the assist request torque D4, an OPEN output unit 92, and a CLOSE output unit 93. The switch 91 selects a signal of the OPEN output unit 92 in the case of the assist request torque D4≥0 and selects a signal of the CLOSE output unit 93 in the case of the assist request torque D4<0.

Further, the valve control task S5 includes a switch 94 that switches according to the boom lowering pilot pressure Pbd and an OPEN output unit 95. The switch 94 selects a signal of the OPEN output unit 95 in the case of the boom lowering pilot pressure Pbd=ON, selects a signal of the switch 91 in the case of the boom lowering pilot pressure Pbd=OFF, and outputs the signal as a command for the unload valve 12.

Further, the valve control task S5 includes a switch 96 that switches according to the assist request torque D4, an OPEN output unit 97, and a CLOSE output unit 98. The switch 96 outputs a signal of the OPEN output unit 97 in the case of the assist request torque D4>0 and outputs a signal of the CLOSE output unit 98 in the case of the assist request torque D4≤0.

Further, the valve control task S5 includes a switch 99 that switches according to the boom lowering pilot pressure Pbd and a CLOSE output unit 100. The switch 99 selects a signal of the CLOSE output unit 100 in the case of the boom lowering pilot pressure Pbd=ON, selects a signal of the switch 96 in the case of the boom lowering pilot pressure Pbd=OFF, and outputs the signal as a command for the accumulator regeneration valve 13.

The action explained above is summarized in Table 2.

TABLE 2

| State of assist pump 10 | Boom lowering pilot pressure Pbd | Assist request torque D4 | Unload valve 12 | Accumulator regeneration valve 13 |
|---|---|---|---|---|
| Swash plate: Min No load | Boom lowering operation ON | + | Open | Close |
| | | 0 | | |
| | | − | | |
| Assist | Boom lowering operation OFF | + | Open | Open |
| Swash plate: Min No load | | 0 | Open | Close |
| Charge | | − | Close | Close |

A control algorithm and action and effects of the control algorithm are explained on the basis of FIG. 4 to FIG. 16.

First, a rough flow of control is explained on the basis of a control block diagram of FIG. 5.

The main pump load torque D1 is calculated by the main pump load torque calculation task S2 on the basis of the main pump pressures Pf and Pr and the main pump swash plate angles θf and θr.

The main pump load torque D1 is input to the assist request torque calculation task S3. Assist torque D2 is calculated by the assist torque calculation task 53. The assist correction torque D3 is calculated by the engine torque feedback control task 54. The assist torque D2 and the assist correction torque D3 are added up by the adder 55 and output as the assist request torque D4.

The assist request torque D4 is input to the assist pump swash plate control task S4. The assist pump swash plate angle ϕ serving as the assist pump swash plate command D5 is calculated. The swash plate angle adjusting unit 10ϕ of the assist pump 10 is controlled. The assist request torque D4 is input to the valve control task S5. The switching signals for the unload valve 12 and the accumulator regeneration valve 13 are output. The unload valve 12 and the accumulator regeneration valve 13 are controlled.

A calculation process of the control is explained below.

(a) Assist Torque Calculation Task 53 (See FIG. 8)

The main pump load torque D1 is subjected to filter processing by the low-pass filter 56 and the smooth torque component Tsm is extracted. The engine setting torque Tes is output by the engine setting torque table 57 on the basis of a signal (the accelerator dial value Ad) input from the accelerator dial 32. The smooth torque component Tsm output from the low-pass filter 56 and the engine setting torque Tes output from the engine setting torque table 57 are compared and a smaller value is selected as the engine target torque Tet by the Min calculator 58.

Further, a difference between the main pump load torque D1 and the engine target torque Tet output from the Min calculator 58 is calculated by the subtracter 59. A fluctuation component of the main pump load torque D1 is extracted as the assist target torque Tat.

Figure 12:
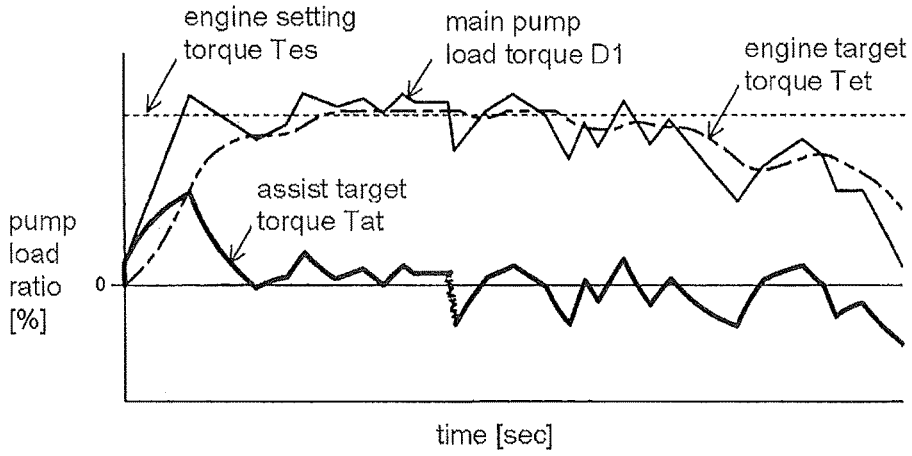
FIG. 12 is a characteristic chart showing an actual example of engine assist control by the control device.

A result of the calculation explained above is shown in a characteristic chart of engine assist control in FIG. 12. An output of the Min calculator 58 is equivalent to the engine target torque Tet and an output of the subtracter 59 is equivalent to the assist target torque Tat.

A plus component of the assist target torque Tat in FIG. 12 is torque for the assist pump 10 to perform motor action to assist driving torque of the engine 6. A minus component of the assist target torque Tat is a torque for driving the assist pump 10 with the engine 6 to perform pump action and charge the accumulator 11.

Referring back to FIG. 8, the output (the engine target torque Tet) of the Min calculator 58 is divided by an output of the engine setting torque table 57 and the engine load ratio Rel is calculated by the divider 60. A plus component (assist torque by the motor action) of the output (the assist target torque Tat) of the subtracter 59 is extracted by the lower limit limiter 61. A minus component (charge torque by the pump action) is extracted by the upper limit limiter 62.

An assist correction coefficient is calculated by the assist correction coefficient setter 63 on the basis of the engine load ratio Rel calculated by the divider 60. Similarly, a charge correction coefficient is calculated by the charge correction coefficient setter 64.

Figure 13:
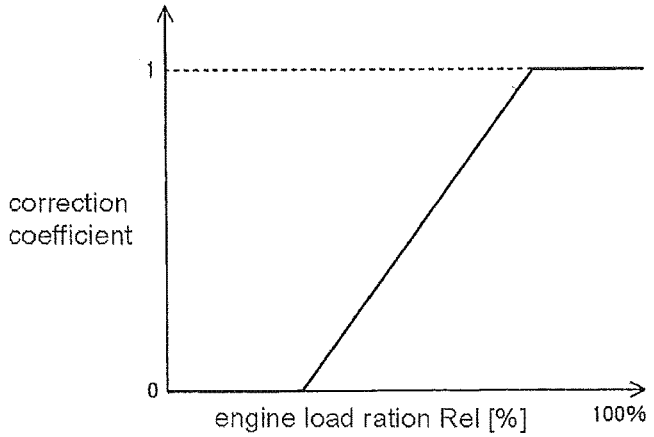
FIG. 13 is a characteristic chart showing a relation between an engine load ratio and a correction coefficient of an assist correction coefficient setter of the control device.

As shown in FIG. 13, the assist correction coefficient setter 63 is set to increase the assist correction coefficient when the engine load ratio Rel is high and reduce the assist correction coefficient when the engine load ratio Rel is low.

Figure 14:
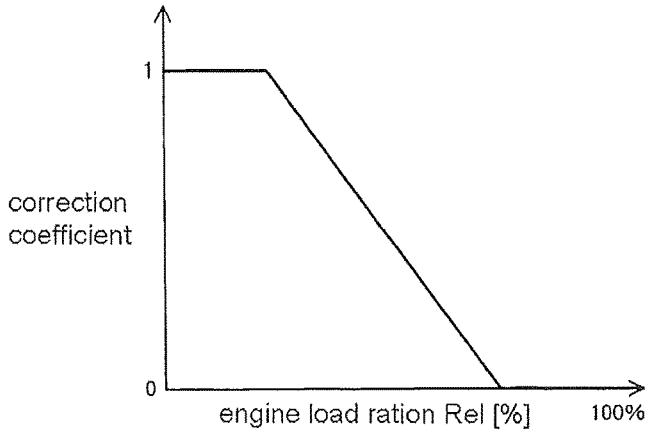
FIG. 14 is a characteristic chart showing a relation between an engine load ratio and a correction coefficient of a charge correction coefficient setter of the control device.

As shown in FIG. 14, the charge correction coefficient setter 64 is set to a characteristic opposite to the characteristic of the assist correction coefficient setter 63.

The plus component of the assist target torque Tat output from the lower limit limiter 61 is multiplied with an output of the assist correction coefficient setter 63 by the multiplier 65. Similarly, the minus component of the assist target torque Tat output from the upper limit limiter 62 is multiplied with an output of the charge correction coefficient setter 64 by the multiplier 66. Outputs of the multiplier 65 and the multiplier 66 are added up by the adder 67.

The switch 70 selects an output of the adder 67 when an output of the OR operation unit 69 is OFF and selects an output "0" of the zero setter 71 when the output of the OR operation unit 69 is ON. The output of the OR operation unit 69 is set as shown in the above Table 1. Therefore, the output is OFF in a machine operation state other than boom lowering and the output of the adder 67 is selected. In boom lowering operation or a non-operation state of a machine, ON is output from the OR operation unit 69 and the output "0" of the zero setter 71 is selected.

When the assist torque D2 is (+), a mode of the assist pump 10 is the engine assist mode by the motor action. When the assist torque D2 is (−), the mode of the assist pump 10 is the accumulator charge mode by the pump action.

(b) Engine Torque Feedback Control Task 54 (See FIG. 9).

Figure 15:
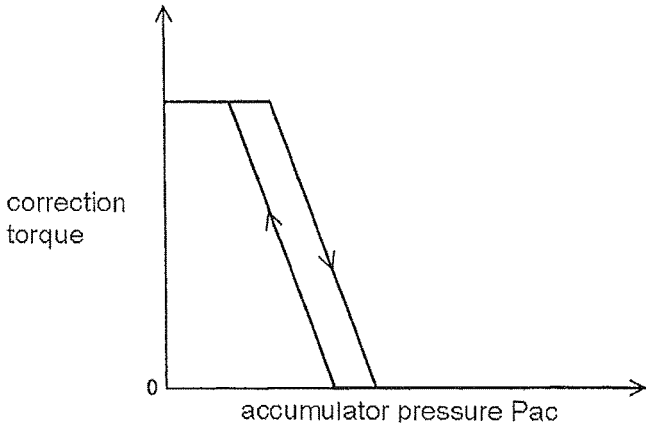
FIG. 15 is a characteristic chart of a correction torque table showing a relation between accumulator pressure and correction torque of the control device.

The smooth torque component Tsm is extracted from the main pump load torque D1 by the low-pass filter 72. The engine setting torque Tes is output by the engine setting torque table 73. Correction torque is output by the correction torque table 74 on the basis of the accumulator pressure Pac. As shown in FIG. 15, the correction torque table 74 is set to increase the correction torque when the accumulator pressure Pac decreases.

The smooth torque component Tsm processed by the low-pass filter 72 and the output of the correction torque table 74 are added up by the adder 75. The output of the engine setting torque table 73 and an output of the adder 75 are compared and smaller value is selected and output as the engine target torque Tet by the Min calculator 76.

The deviation signal ΔT between the engine target torque Tet output from the Min calculator 76 and the engine actual torque Tea detected by the engine torque sensor 41 is calculated by the subtracter 77. The deviation signal ΔT is subjected to PID operation processing by the control operation unit 78 and the assist correction torque D3 is output. When the assist correction torque D3 is (+), the mode of the assist pump 10 is the engine assist mode by the motor action. When the assist correction torque D3 is (−), the mode of the assist pump 10 is the accumulator charge mode by the pump action.

The control operation unit 78 is reset when an output of the OR operation unit 80 is ON. Like the OR operation unit 69 shown in FIG. 8, the output of the OR operation unit 80 is set as shown in the above Table 1. Therefore, in a machine operation state other than boom lowering, the output of the OR operation unit 80 is OFF. The control operation unit 78 outputs the assist correction torque D3. In the boom lowering operation or in the non-operation state of the machine, ON (a reset signal) is output from the OR operation unit 80. The output of the control operation unit 78 decreases to zero.

When the assist correction torque D3 is (+), the mode of the assist pump 10 is the engine assist mode by the motor action. When the assist correction torque D3 is (−), the mode of the assist pump 10 is the accumulator charge mode by the pump action.

The assist correction torque D3 calculated as explained above is added to the assist torque D2 as shown in FIG. 7 to be the assist request torque D4. When the assist request torque D4 is (+), the mode of the assist pump 10 is the engine assist mode by the motor action. When the assist request torque D4 is (−), the mode of the assist pump 10 is the accumulator charge mode by the pump action.

(c) Assist Pump Swash Plate Control Task S4 (See FIG. 10)

The assist request torque D4 output from the assist request torque calculation task S3 is input to the assist pump swash plate control task S4. The assist pump swash plate angle ϕ serving as the assist pump swash plate command D5 is calculated by calculation explained below.

The assist pump differential pressure ΔP between the assist pump inlet pressure Pin and the assist pump outlet pressure Pout is calculated by the subtracter 81. A plus component of the assist request torque D4 is extracted by the lower limit limiter 82. An assist upper limit torque is set by the assist upper limit torque setter 83 on the basis of the accumulator pressure Pac. An output of the lower limit limiter 82 and an output of the assist upper limit torque setter 83 are compared and a smaller value is selected by the Min calculator 84.

Similarly, a minus component of the assist request torque D4 is extracted by the upper limit limiter 85. A charger upper limit torque is set by the charge upper limit torque setter 86 on the basis of the accumulator pressure Pac. An output of the upper limit limiter 85 and an output of the charge upper limit torque setter 86 are compared and a larger value is selected by the Max calculator 87.

An assist pump swash plate angle command value (the assist swash plate angle ϕas) during assist is calculated by the assist swash plate angle calculator 88 on the basis of an output of the Min calculator 84 and the assist pump differential pressure ΔP output from the subtracter 81. Similarly, an assist pump swash plate angle command value (the charge swash plate angle ϕch) during charging is calculated by the charge swash plate angle calculator 89 on the basis of an output of the Max calculator 87 and the assist pump differential pressure ΔP output from the subtracter 81.

An output of the assist swash plate angle calculator 88 and an output of the charge swash plate angle calculator 89 are switched by the switch 90 according to plus/minus of the assist request torque D4. The assist pump swash plate angle ϕ (the assist swash plate angle ϕas or the charge swash plate angle ϕch) serving as the assist pump swash plate command D5 is output and the swash plate of the assist pump 10 is controlled.

(d) Valve Control Task S5 (See FIG. 11)

The unload valve 12 and the accumulator regeneration valve 13 are controlled as shown in Table 2 by logical operation blocks of the valve control task S5 shown in FIG. 11.

(e) Summary

According to the action explained above, as shown in FIG. 8, smooth torque is extracted from the main pump load torque D1 by the low-pass filter 56. A difference between the main pump load torque D1 and the smooth torque is set as the assist torque D2. The assist torque D2 is corrected according to a load state of the engine and adjusted to increase assist torque when the engine load ratio Rel is high and increase charge torque when the engine load ratio Rel is low.

As shown in FIG. 9, the smooth torque is set as the engine target torque Tet, the engine actual torque Tea is fed back to calculate the deviation signal ΔT between the engine target torque Tet and the engine actual torque Tea. The assist correction torque D3 is calculated by PID control (proportional, integral, and differential control) or the like.

The assist torque D2 is a feed-forward component and the assist correction torque D3 is a feedback component. As shown in FIG. 7, the assist torque D2 and the assist correction torque D3 are added up as the assist request torque D4. The swash plate of the assist pump 10 is controlled to assist the engine 6.

In boom lowering operation, the unload valve 12 is opened and the accumulator regeneration valve 13 is closed to minimize the angle of the swash plate of the assist pump 10. Therefore, pressure oil in the head chamber of the boom cylinder 3*a* during boom lowering is directly charged in the accumulator 11.

Effects of the embodiment shown in FIG. 1 to FIG. 16 are enumerated below.

As shown in FIG. 12, the main pump load torque D1 is separated into the assist target torque Tat and the engine target torque Tet. The torque of the assist pump 10 is controlled to be the assist target torque Tat and assists the engine. Therefore, it is possible to smoothly change the engine actual torque Tea like the engine target torque Tet.

When the pressure of the accumulator 11 decreases, control is performed to gradually increase the engine target torque Tet and perform charging. Then, the engine target torque Tet smoothed by the engine setting torque Tes becomes more flat. Therefore, it is possible to effectively suppress load fluctuation of the engine. This leads to suppression of exhaust gas, a reduction in the size of the engine 6, and a reduction in the size of a post processing device, that is, an exhaust gas purifier involved in the suppression of the exhaust gas and the reduction in the size of the engine 6.

Figure 16:
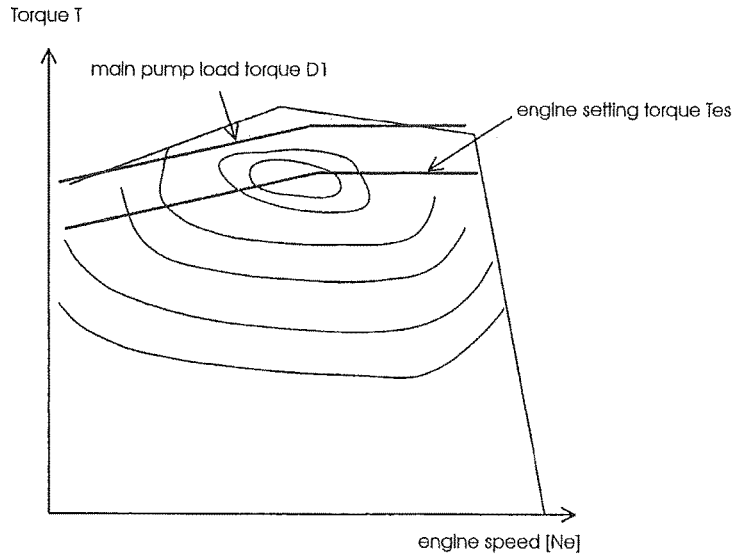
FIG. 16 is a characteristic chart showing a relation between main pump load torque and engine setting torque of the control device.

Since the engine 6 is assisted using the pressure oil of the accumulator 11, as shown in FIG. 16, the engine setting torque Tes set by the accelerator dial 32 can be set lower than the main pump load torque D1. Therefore, it is possible to operate the engine in a region with high fuel efficiency and further improve the fuel efficiency.

Pressure oil of the boom lowering and the swing brake is accumulated in the accumulator 11 and, when the load of the engine 6 is low, pressure is accumulated in the accumulator 11 by the assist pump 10. Therefore, it is possible to sufficiently secure energy for assisting the engine 6. Therefore, it is possible to reduce the engine 6 in size and reduce a cooling device for the engine and a related device such as an air cleaner in size according to the reduction in the size of the engine.

The engine 6 is assisted by the assist pump 10 during high load of the engine 6 and pressure is accumulated in the accumulator 11 by the assist pump 10 during low load of the engine 6. Therefore, it is possible to smooth the load of the engine 6 and the fuel efficiency is improved. Further, it is possible to reduce exhaust gas such as black smoke.

Since the pressure oil of the boom lowering and the swing brake is collected, it is possible to reduce an energy loss of a hydraulic device and reduce a hydraulic cooling device in size.

Since the system is configured by the hydraulic machine, compared with the hybrid system in which the electric system is used, it is possible to substantially reduce costs, maintenance is less frequently performed, and it is possible to reduce running costs. Further, it is possible to easily mount the system on the conventional working machine.

The smooth torque component Tsm is separated from the main pump load torque D1 by the subtracter 59 functioning as the assist target torque calculating means. The minimum of the smooth torque component Tsm and the engine setting torque Tes is set as the engine target torque Tet. The engine actual torque Tea is controlled by the engine controller 31 according to the engine target torque Tet. The assist target torque Tat is calculated by the subtracter 59 from a difference between the main pump load torque D1 and the engine target torque Tet. The capacity (i.e., the assist pump swash plate angle ϕ) of the assist pump 10 and the switching of the assist mode of the engine 6 and the charge mode of the accumulator 11 (the switching of the unload valve 12 and the accumulator regeneration valve 13) are controlled by the machine controller 30 on the basis of the assist target torque Tat. Therefore, load fluctuation is absorbed by the control of the assist pump capacity and the mode switching by the machine controller 30 having high responsiveness to a torque request that frequently changes. Consequently, it is possible to smooth the engine target torque Tet and smoothly change the engine actual torque Tea according to the engine target torque Tet. Moreover, a large-capacity generator motor, battery, or the like is unnecessary. Therefore, it is possible to provide the small and inexpensive control device C that can effectively suppress load fluctuation of the engine 6 according to, for example, a state of the main pump circuit.

In particular, the engine target torque calculation task 101 sets, as the engine target torque Tet, the minimum of the smooth torque component Tsm separated from the main pump load torque D1 and the engine setting torque Tes. Therefore, when the pressure of the accumulator 11 decreases, the control is performed to gradually increase the engine target torque Tet and perform charging. Therefore, it is possible to more flatly change the engine target torque Tet smoothed by the engine setting torque Tes. It is possible to effectively suppress load fluctuation of the engine 6. Further it is possible to attain suppression of exhaust gas and a reduction in the size of the engine 6 and the post processing device of the engine 6, that is, the exhaust gas purifier.

The assist target torque Tat is multiplied with the engine load ratio Rel, which is calculated by dividing the engine target torque Tet by the engine setting torque Tes, to calculate the assist torque D2 as the feed-forward torque. Further, the assist correction torque D3 is calculated on the basis of the deviation signal ΔT obtained by feeding back the engine actual torque Tea to the engine target torque Tet. The assist torque D2 and the assist correction torque D3 are added up to calculate the assist request torque D4. Therefore, according to the accurate assist request torque D4 corrected by the engine load ratio Rel and the engine actual torque Tea, it is possible to output the accurate assist pump swash plate command D5 to the assist pump 10 that variably adjusts the pump capacity according to the assist pump swash plate angle ϕ.

The engine target torque Tet is divided by the engine setting torque Tes to calculate the engine load ratio Rel. The assist target torque Tat is corrected to increase the assist torque when the engine load ratio Rel is high and increase the charge torque when the engine load ratio Rel is low. Therefore, it is possible to appropriately adjust the assist target torque Tat according to a load state of the engine 6.

When the machine body B and the front working device F are actuated in the working machine hydraulically driven HE, with the accumulator 11 of the control device C including the function of accumulating and discharging brake energy of the swing motor 9 of the machine body B and position energy of the boom cylinder 3*a* and the like of the front working device F, it is possible to effectively use the brake energy and the position energy of the working machine HE. It is possible to effectively suppress load fluctuation of the engine 6. It is possible to attain suppression of exhaust gas and a reduction in the sizes of the engine 6 and the post processing device.

Figure 17:
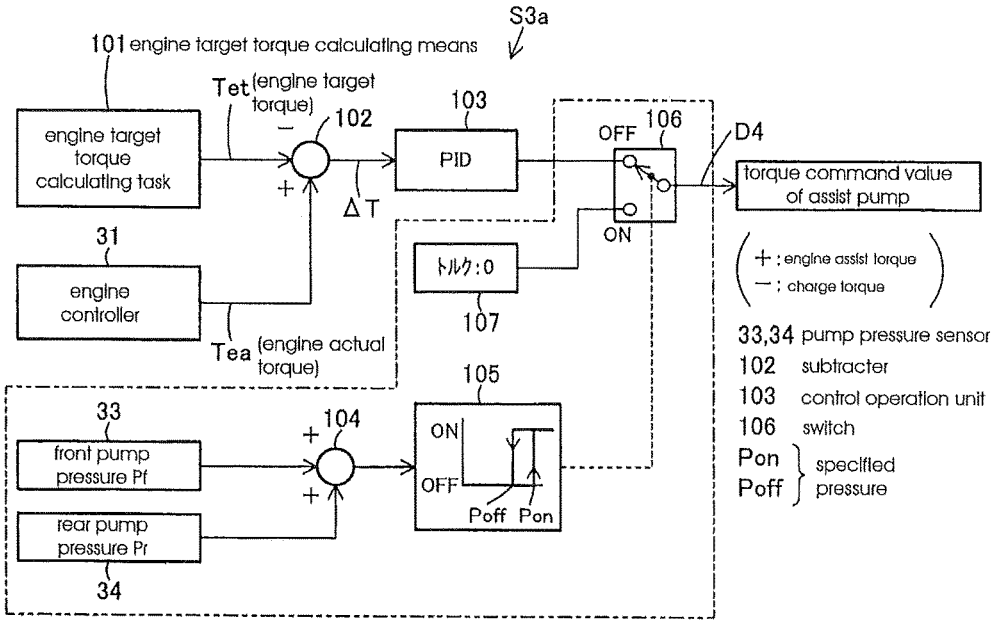
FIG. 17 is a calculation block diagram showing another embodiment of the control device.

FIG. 17 is an assist command torque calculation task S3*a* showing another embodiment of the assist request torque calculation task S3 that calculates the assist request torque D4, which is a torque command value of the assist pump 10, in the machine controller 30. Note that the components shown in FIG. 1 to FIG. 4, FIG. 6, FIG. 10, and FIG. 11 are the same. Therefore, explanation of the components is omitted.

The assist command torque calculation task S3*a* includes the engine target torque calculation task 101 functioning as engine target torque calculating means for calculating the engine target torque Tet from the main pump load torque D1 and the accelerator dial value Ad, a subtracter 102 that calculates the deviation signal ΔT between the engine target torque Tet and the engine actual torque Tea, and a control operation unit 103 that subjects the deviation signal ΔT output from the subtracter 102 to PID control.

As shown in FIG. 8, the engine target torque calculation task 101 separates, with the low-pass filter 56, the smooth torque component Tsm from the main pump load torque D1 and outputs, as the engine target torque Tet, a minimum selected by comparing, with the Min calculator 58, the smooth torque component Tsm and the engine setting torque Tes calculated by the engine setting torque table 57 from the accelerator dial value Ad.

Therefore, the smooth torque component Tsm is separated from the main pump load torque D1 and the minimum of the smooth torque component Tsm and the engine setting torque Tes is set as the engine target torque Tet by the engine target torque calculation task 101. The deviation signal ΔT between the engine target torque Tet and the engine actual torque Tea obtained from the engine controller 31 is subjected to the PID control to calculate a torque command value (the assist request torque D4) of the assist pump 10. The capacity (i.e., the assist pump swash plate angle ϕ) of the assist pump 10 and the switching of the assist mode of the engine 6 and the charge mode of the accumulator 11 are controlled by the assist pump swash plate control task S4 and the valve control task S5 shown in FIG. 5 on the basis of the torque command value.

In this way, load fluctuation is absorbed by the assist pump capacity control and the mode switching control by the machine controller 30 having high responsiveness to a torque request that frequently changes. Consequently, it is possible to smooth the engine target torque Tet and smoothly change the engine actual torque Tea according to the engine target torque Tet. Moreover, a large-capacity generator motor, battery, or the like is unnecessary. Therefore, it is possible to provide the small and inexpensive control device C that can effectively suppress load fluctuation of the engine 6 according to, for example, a state of the main pump circuit.

Further, as indicated by a portion surrounded by an alternate long and two short dashes line in FIG. 17, the assist command torque calculation task S3*a* includes an adder 104 that detects a sum of the main pump pressures Pf and Pr detected by the pump pressure sensors 33 and 34, a main pump pressure determination table 105 functioning as main pump pressure determining means for outputting an ON signal when the sum of the main pump pressures Pf and Pr is higher than first specified pressure Pon and outputting an OFF signal when the sum of the main pump pressures Pf and Pr is lower than second specified pressure Poff (smaller than the first specified pressure Pon), and a switch 106 that switches according to an output of the main pump pressure determination table 105.

The switch 106 selects an output of the control operation unit 103 when an output of the main pump pressure determination table 105 is OFF and selects a torque "0" of a zero setter 107 when the output of the main pump pressure determination table 105 is ON.

The engine target torque Tet is calculated and set from the main pump load torque D1 or the like by the engine target torque calculation task 101. The engine actual torque Tea output from the engine controller 31 is fed back to the engine target torque Tet. The deviation signal ΔT between the engine target torque Tet and the engine actual torque Tea is calculated by the subtracter 102. The deviation signal ΔT is subjected to the PID control by the control operation unit 103.

As indicated by the portion surrounded by the alternate long and two short dashes line in FIG. 17, when the sum of the main pump pressures Pf and Pr is higher than the first specified pressure Pon, the switch 106 switches from the OFF side to the ON side according to the ON signal output from the main pump pressure determination table 105. Therefore, a torque command value (the assist request torque D4) of the assist pump 10 changes to "0". The assist of the engine 6 by the assist pump 10 and the pressure accumulation of the accumulator 11 are stopped.

When the sum of the main pump pressures Pf and Pr is lower than the second specified pressure Poff, the switch 106 switches from the ON side to the OFF side according to the OFF signal output from the main pump pressure determination table 105. The assist of the engine 6 by the assist pump 10 and the pressure accumulation of the accumulator 11 are resumed. An output subjected to the PID control by the control operation unit 103 becomes the torque command value (the assist request torque D4) of the assist pump 10. When the assist request torque D4 is "+", the torque of the assist pump 10 is engine assist torque for assisting the engine 6 with the assist pump 10. When the assist request torque D4 is "−", the torque of the assist pump 10 is accumulator charge torque for accumulating pressure in the accumulator 11 with the assist pump 10.

Therefore, in a relief state in which a relief valve (not shown in the figure) provided in a discharge circuit of the main pumps 7 and 8 performs relief operation, that is, in a relief state in which the sum of the main pump pressures Pf and Pr is higher than the specified pressure Pon, the torque command value of the assist pump 10 is set to zero to stop the assist of the engine 6. When the sum of the main pump pressures Pf and Pr is lower than the specified pressure Poff, the assist of the engine 6 is resumed. That is, the engine 6 is not assisted during the relief state. Therefore, it is possible to prevent useless consumption of energy accumulated in the accumulator 11.

By providing a dead zone between the specified pressures Pon and Poff according to hysteresis of the main pump pressure determination table 105, it is possible to prevent unstable ON/OFF switching and secure stability of a control system.

Note that, when the assist command torque calculation task S3*a* does not include the portion surrounded by the alternate long and two short dashes line in FIG. 17, even when the main pump pressures Pf and Pr of the hydraulic oil discharged from the main pumps 7 and 8 rise and the assist command torque calculation task S3*a* changes to the relief state, the pressure oil of the accumulator 11 is supplied to the assist pump 10 to assist the engine 6. Therefore, the energy of the accumulator 11 is uselessly consumed.

INDUSTRIAL APPLICABILITY

The present invention has industrial applicability for business operators that, for example, manufacture and sell a control device including an assist pump and an accumulator and a working machine mounted with the control device.

EXPLANATION OF REFERENCE NUMERALS

HE Working machine
B Machine body
F Front working device functioning as working device
C Control device
6 Engine
7 Front pump functioning as main pump
8 Rear pump functioning as main pump
10 Assist pump
10ϕ Swash plate angle adjusting unit
11 Accumulator
30 Machine controller functioning as assist pump control means
31 Engine controller functioning as engine control means
32 Accelerator dial functioning as accelerator means
33, 34 Pump pressure sensors
37 Accumulator pressure sensor functioning as accumulator pressure detecting means
41 Engine torque sensor functioning as engine actual torque acquiring means
53 Assist torque calculation task functioning as assist torque calculating means
54 Engine torque feedback control task functioning as engine torque feedback control means
55 Adder
59 Subtracter functioning as assist target torque calculating means
60 Divider
63 Assist correction coefficient setter functioning as correction coefficient setter
64 Charge correction coefficient setter functioning as correction coefficient setter
65, 66 Multipliers
81 Subtracter functioning as assist pump differential pressure acquiring means
101 Engine target torque calculation task functioning as engine target torque calculating means
102 Subtracter
103 Control operation unit
106 Switch
Pac Accumulator pressure
Pin Assist pump inlet pressure
Pout Assist pump outlet pressure
ΔP Assist pump differential pressure
ϕ Assist pump swash plate angle
Tsm Smooth torque component
Tes Engine setting torque
Tet Engine target torque
Tat Assist target torque
Rel Engine load ratio
Tea Engine actual torque
ΔT Deviation signal
D1 Main pump load torque
D2 Assist torque serving as feed-forward torque
D3 Assist correction torque
D4 Assist request torque
D5 Assist pump swash plate command
S2 Main pump load torque calculation task functioning as main pump load torque calculating means
S4 Assist pump swash plate control task functioning as assist pump swash plate control means
Pf Front pump pressure serving as main pump pressure
Pr Rear pump pressure serving as main pump pressure
Pon Specified pressure
Poff Specified pressure
FIG. 1
C CONTROL DEVICE
6 ENGINE
31 ENGINE CONTROL MEANS
11 ACCUMULATOR
37 ACCUMULATOR PRESSURE DETECTING MEANS
30 ASSIST PUMP CONTROL MEANS
7, 8 MAIN PUMP
10 ASSIST PUMP
10ϕ SWASH PLATE ANGLE ADJUSTING UNIT
32 ACCELERATOR MEANS
33, 34 PUMP PRESSURE SENSOR
41 ENGINE ACTUAL TORQUE ACQUIRING MEANS
FIG. 2
HE WORKING MACHINE
F WORKING DEVICE
B MACHINE BODY
FIG. 3
32 ACCELERATOR DIAL VALUE Ad
33 FRONT PUMP PRESSURE Pf
34 REAR PUMP PRESSURE PR
35 FRONT PUMP SWASH PLATE ANGLE θf
36 REAR PUMP SWASH PLATE ANGLE θr
37 ACCUMULATOR PRESSURE Pac
38 ASSIST PUMP INLET PRESSURE Pin
39 ASSIST PUMP OUTLET PRESSURE Pout
42 OPERATION PILOT PRESSURE Ppi
43 BOOM LOWERING PILOT PRESSURE Pbd
30 MACHINE CONTROLLER
17 ELECTROMAGNETIC PROPORTIONAL VALVE FOR POWER SHIFT
10ϕ ASSIST PUMP SWASH PLATE
12 UNLOAD VALVE
13 ACCUMULATOR REGENERATION VALVE
D6 ENGINE SETTING SPEED
ENGINE ACTUAL SPEED Ne
ENGINE ACTUAL TORQUE Tea
31 ENGINE CONTROLLER
6 ENGINE
40 ENGINE ACTUAL SPEED Ne
41 ENGINE ACTUAL TORQUE Tea
FIG. 4
START
S1 INPUT PROCESSING TASK
S2 MAIN PUMP LOAD TORQUE CALCULATION TASK MAIN PUMP LOAD TORQUE CALCULATING MEANS
S3 ASSIST REQUEST TORQUE CALCULATION TASK
S4 ASSIST PUMP SWASH PLATE CONTROL TASK ASSIST PUMP SWASH PLATE CONTROL MEANS
S5 VALVE CONTROL TASK
RETURN TO START
FIG. 5
30 ASSIST PUMP CONTROL MEANS
41 ENGINE ACTUAL TORQUE Tea
32 ACCELERATOR DIAL VALUE Ad
37 ACCUMULATOR PRESSURE Pac

42 OPERATION PILOT PRESSURE Ppi
43 BOOM LOWERING PILOT PRESSURE Pbd
33, 34 MAIN PUMP PRESSURES Pf, Pr
35, 36 MAIN PUMP SWASH PLATE ANGLES θf, θr
38 ASSIST PUMP INLET PRESSURE Pin
39 ASSIST PUMP OUTLET PRESSURE Pout
S2 MAIN PUMP LOAD TORQUE CALCULATION TASK
54 ENGINE TORQUE FEEDBACK CONTROL TASK
53 ASSIST TORQUE CALCULATION TASK
S5 VALVE CONTROL TASK
S4 ASSIST PUMP SWASH PLATE CONTROL TASK
53 ASSIST TORQUE CALCULATING MEANS
54 ENGINE TORQUE FEEDBACK CONTROL MEANS
55 ADDER
D1 MAIN PUMP LOAD TORQUE
D2 ASSIST TORQUE
D3 ASSIST CORRECTION TORQUE
D4 ASSIST REQUEST TORQUE
13 ACC REGENERATION VALVE COMMAND
12 UNLOAD VALVE COMMAND
D5 ASSIST PUMP SWASH PLATE COMMAND
10ϕ ASSIST PUMP SWASH PLATE ANGLE ϕ
FIG. 6
33 FRONT PUMP PRESSURE Pf
35 FRONT PUMP SWASH PLATE ANGLE θf
34 REAR PUMP PRESSURE Pr
36 REAR PUMP SWASH PLATE ANGLE θr
PUMP TORQUE CALCULATION
PUMP MAXIMUM CAPACITY
TORQUE EFFICIENCY
D1 MAIN PUMP LOAD TORQUE
FIG. 7
37 ACCUMULATOR PRESSURE Pac
D1 MAIN PUMP LOAD TORQUE
32 ACCELERATOR DIAL VALUE Ad
42 OPERATION PILOT PRESSURE Ppi
43 BOOM LOWERING PILOT PRESSURE Pbd
41 ENGINE ACTUAL TORQUE Tea
54 ENGINE TORQUE FEEDBACK CONTROL TASK
53 ASSIST TORQUE CALCULATION TASK
55 ADDER
D4 ASSIST REQUEST TORQUE
REQUEST TORQUE
ASSIST
CHARGE
FIG. 8
53 ASSIST TORQUE CALCULATING MEANS
42 OPERATION PILOT PRESSURE Ppi
43 BOOM LOWERING PILOT PRESSURE Pbd
D1 MAIN PUMP LOAD TORQUE
32 ACCELERATOR DIAL VALUE Ad
59 ASSIST TARGET TORQUE CALCULATING MEANS
56 LPF PROCESSING
ENGINE SETTING TORQUE
ACCELERATOR DIAL
101 ENGINE TARGET TORQUE CALCULATING MEANS
56 LOW-PASS FILTER
60 DIVIDER
63, 64 CORRECTION COEFFICIENT SETTER
65, 66 MULTIPLIER
Tsm SMOOTH TORQUE COMPONENT
Tes ENGINE SETTING TORQUE
Tet ENGINE TARGET TORQUE
Tat ASSIST TARGET TORQUE
Rel ENGINE LOAD RATIO.
D2 ASSIST TORQUE
ASSIST TORQUE
ASSIST
CHARGE
FIG. 9
54 ENGINE TORQUE FEEDBACK CONTROL MEANS
37 ACCUMULATOR PRESSURE Pac
D1 MAIN PUMP LOAD TORQUE
32 ACCELERATOR DIAL VALUE Ad
41 ENGINE ACTUAL TORQUE Tea
42 OPERATION PILOT PRESSURE Ppi
43 BOOM LOWERING PILOT PRESSURE Pbd
CORRECTION TORQUE
ACC PRESSURE
72 LPF PROCESSING
ENGINE SETTING TORQUE
ACCELERATOR DIAL
D3 ASSIST CORRECTION TORQUE
ASSIST TORQUE
ASSIST
CHARGE
Tsm SMOOTH TORQUE COMPONENT
Tes ENGINE SETTING TORQUE
Tet ENGINE TARGET TORQUE
Tea ENGINE ACTUAL TORQUE
ΔT DEVIATION SIGNAL
FIG. 10
S4 ASSIST PUMP SWASH PLATE CONTROL MEANS
38 ASSIST PUMP INLET PRESSURE Pin
39 ASSIST PUMP OUTLET PRESSURE Pout
37 ACCUMULATOR PRESSURE Pac
D4 ASSIST REQUEST TORQUE
ASSIST TORQUE
ASSIST
CHARGE
81 ASSIST PUMP DIFFERENTIAL PRESSURE ACQUIRING MEANS DIFFERENTIAL PRESSURE
MOTOR ACTION
PUMP ACTION
ASSIST UPPER LIMIT TORQUE
LOWER LIMIT LIMITER
UPPER LIMIT LIMITER
CHARGE UPPER LIMIT TORQUE
ACC PRESSURE
ΔP ASSIST PUMP DIFFERENTIAL PRESSURE
CALCULATE ASSIST SWASH PLATE ANGLE ϕas
ASSIST PUMP MAXIMUM CAPACITY
TORQUE EFFICIENCY
CALCULATE CHARGE SWASH PLATE ANGLE ϕch
10ϕ ASSIST PUMP SWASH PLATE ANGLE ϕ
FIG. 11
43 BOOM LOWERING PILOT PRESSURE Pbd
D4 ASSIST REQUEST TORQUE
12 UNLOAD VALVE
13 ACCUMULATOR REGENERATION VALVE
FIG. 12
PUMP LOAD RATIO
ENGINE SETTING TORQUE
MAIN PUMP LOAD TORQUE
ENGINE TARGET TORQUE
ASSIST TARGET TORQUE
TIME
FIG. 13
CORRECTION COEFFICIENT
ENGINE LOAD RATIO
FIG. 14
CORRECTION COEFFICIENT
ENGINE LOAD RATIO FIG. 15
CORRECTION TORQUE
ACCUMULATOR PRESSURE
FIG. 16
TORQUE
MAIN PUMP LOAD
ENGINE SETTING TORQUE
ENGINE SPEED
FIG. 17
101 ENGINE TARGET TORQUE CALCULATING MEANS
ENGINE TARGET TORQUE CALCULATION TASK
31 ENGINE CONTROLLER
33 FRONT PUMP PRESSURE Pf
34 REAR PUMP PRESSURE Pr
ENGINE TARGET TORQUE
ENGINE ACTUAL TORQUE
TORQUE COMMAND VALUE OF ASSIST PUMP
ENGINE ASSIST TORQUE
CHARGE TORQUE
33, 34 PUMP PRESSURE SENSOR
102 SUBTRACTER
103 CONTROL OPERATION UNIT
106 SWITCH
Pon, Poff SPECIFIED PRESSURE

The invention claimed is:

1. A hydraulic system and control device comprising:
a main pump driven by an engine and supplying hydraulic oil to a hydraulic circuit;
a variable capacity assist pump coupled to an engine or a main pump and having both functions of a pump and a motor;
an accumulator provided to be capable of communicating with the assist pump, and accumulating hydraulic energy;
an accelerator means for inputting engine setting torque;
an engine actual torque acquiring means for detecting or calculating engine actual torque;
an engine control means for controlling the engine actual torque; and
an assist pump control means for controlling a capacity of the assist pump and switching between an assist mode for assisting the engine with the motor function of the assist pump and a charge mode for accumulating pressure in the accumulator with the pump function of the assist pump, wherein
the assist pump control means includes:
a main pump load torque calculating means for calculating main pump load torque applied to the main pump;
an engine target torque calculating means including a low pass filter for separating a smooth torque component from the main pump load torque and setting, as an engine target torque, a minimum of the smooth torque component and the engine setting torque;
an assist target torque calculating means for calculating an assist target torque from a difference between the main pump load torque and the engine target torque; and
a function for controlling the capacity of the assist pump and controlling the switching of the assist mode and the charge mode on the basis of the assist target torque.

2. The hydraulic system and control device according to claim 1, wherein
the assist pump includes:
a swash plate for variably adjusting a pump capacity; and
a swash plate angle adjusting unit that adjusts an angle of the assist pump swash plate, and
the assist pump control means includes:
an accumulator pressure detecting means for detecting accumulator pressure of the accumulator;
an assist pump differential pressure acquiring means for detecting inlet pressure and outlet pressure of the assist pump and thereby calculating assist pump differential pressure;
an assist torque calculating means for multiplying the assist target torque with an engine load ratio, which is calculated by dividing the engine target torque by the engine setting torque, to obtain assist torque as feed-forward torque;
an engine torque feedback control means for calculating assist correction torque on the basis of a deviation signal obtained by feeding back the engine actual torque to the engine target torque;
an adder that adds up the assist torque calculated by the assist torque calculating means and the assist correction torque calculated by the engine torque feedback control means, thereby obtaining assist request torque; and
an assist pump swash plate control means for receiving inputs of the assist request torque, the accumulator pressure, and the assist pump differential pressure to calculate an assist pump swash plate angle and thereby outputting an assist pump swash plate command and controlling the assist pump swash plate angle to smooth the engine actual torque.

3. The hydraulic system and control device according to claim 2, wherein
the assist torque calculating means includes:
a divider that divides the engine target torque by the engine setting torque to calculate the engine load ratio;
a correction coefficient setter that adjusts the assist torque to increase when the engine load ratio is high and adjusts the charge torque to increase when the engine load ratio is low; and
a multiplier that multiplies the assist target torque with an output of the correction coefficient setter to correct the assist target torque.

4. A working machine comprising:
a machine body hydraulically driven;
a working device mounted on the machine body; and
the hydraulic system and control device according to claim 1 provided for the machine body and the working device, wherein
the accumulator of the hydraulic system and control device includes a function of accumulating and discharging brake energy of the machine body and position energy of the working device.

5. A hydraulic system and control device comprising:
a main pump driven by an engine and supplying hydraulic oil to a hydraulic circuit;
a variable capacity assist pump coupled to an engine or a main pump and having both functions of a pump and a motor;
an accumulator provided be capable of communicating with the assist pump, and accumulating hydraulic energy;

a accelerator means for inputting engine setting torque;

an engine actual torque acquiring means for detecting or calculating engine actual torque;

an engine control means for controlling the engine actual torque; and an assist pump control means for controlling a capacity of the assist pump and implementing switching between an assist mode for assisting the engine with the motor function of the assist pump and a charge mode for accumulating pressure in the accumulator with the pump function of the assist pump, wherein the assist pump control means includes:

a main pump load torque calculating means for calculating main pump load torque applied to the main pump;

an engine target torque calculating means including a low pass filter for separating a smooth torque component from the main pump load torque and setting, as an engine target torque, a minimum of the smooth torque component and the engine setting torque;

a subtracter that calculates a deviation between the engine target torque and the engine actual torque;

a control operation unit that subjects an output of the subtracter to PID operation processing to obtain a torque command value of the assist pump;

a pump pressure sensor that detects main pump pressure;

a switch that implements switching to set the torque command value of the assist pump to zero when the main pump pressure is higher than specified pressure and select an output of the control operation unit and set the output as the torque command value of the assist pump when the main pump pressure is lower than the specified pressure; and a function for controlling the capacity of the assist pump on the basis of the torque command value and controlling the switching of the assist mode and the charge mode.

6. A working machine comprising:

a machine body hydraulically driven;

a working device mounted on the machine body; and the hydraulic system and control device according to claim 5 provided for the machine body and the working device, wherein the accumulator of the hydraulic system and control device includes a function of accumulating and discharging brake energy of the machine body and position energy of the working device.

* * * * *